US005580708A

United States Patent [19]

Kawai et al.

[11] Patent Number: 5,580,708

[45] Date of Patent: Dec. 3, 1996

[54] SILVER HALIDE PHOTOGRAPHIC MATERIAL AND COLOR IMAGE FORMING PROCESS

[75] Inventors: Kiyoshi Kawai; Mario Aoki, both of Kanagawa, Japan

[73] Assignee: Fuji Photo Film Co., Ltd., Kanagawa, Japan

[21] Appl. No.: 303,734

[22] Filed: Sep. 9, 1994

[30] Foreign Application Priority Data

Sep. 9, 1993 [JP] Japan ..... 5-224627
Sep. 10, 1993 [JP] Japan ..... 5-225524

[51] Int. Cl.[6] ..... G03C 1/46

[52] U.S. Cl. ..... 430/507; 430/510; 430/517; 430/522; 430/523; 430/531; 430/533; 430/383

[58] Field of Search ..... 430/507, 510, 430/517, 522, 523, 531, 533, 383

[56] References Cited

U.S. PATENT DOCUMENTS 5,252,447 10/1993 Ohtani et al. ..... 430/517

FOREIGN PATENT DOCUMENTS 0337490 10/1989 European Pat. Off. .
0388194 9/1990 European Pat. Off. .
0460616 12/1991 European Pat. Off. .
0459456 12/1991 European Pat. Off. .
62-185755 8/1987 Japan .
63-200147 8/1988 Japan .
4-256948 9/1992 Japan .
318174 9/1992 Japan .

*Primary Examiner*—Geraldine Letscher
*Attorney, Agent, or Firm*—Sughrue, Mion, Zinn, Macpeak & Seas

[57] ABSTRACT

A silver halide photographic material is disclosed, which has on a reflective support at least one light-sensitive layer containing silver halide emulsion grains, wherein said reflective support has at least one waterproof resin coated layer which contains at least 2 g/m$^2$ of a white pigment in waterproof resin coated layer at the light-sensitive layer coated side and further at least one light-sensitive layer contains at least one compound represented by following general formula (I) in a molecular dispersion state of a monomolecule or a dimer;

(I)

wherein $R_1$ to $R_4$ each represent a hydrogen atom or a substituent, the sum total of the atomic weights of at least one of ($R_1$+$R_3$) and ($R_2$+$R_4$) being not more than 160; n represents 0, 1, or 2; and M represents a hydrogen atom or an alkali metal.

20 Claims, No Drawings

SILVER HALIDE PHOTOGRAPHIC MATERIAL AND COLOR IMAGE FORMING PROCESS

FIELD OF THE INVENTION

The present invention relates to a silver halide photographic material, and more particularly to a silver halide photographic material giving no color residue by quick processing, being excellent in sharpness, and forming less fog by applying a pressure to the light-sensitive photographic material before processing.

BACKGROUND OF THE INVENTION

Recently, various electronic image-forming means have been developed and the image qualities thereof have been compared with those of silver halide photographic materials. Also, as the result of the comparison, the high image quality and the easiness of the silver halide photographic material have been newly recognized. Accordingly, it has been investigated to use the silver halide color photographic materials not only for a printing material of a photograph but also for a hard copy material of an electronic image. In such a circumstance, the investigations of improving the sharpness and the color reproducibility to further increase the image quality of the silver halide photographic material and improving the processing time and the processing process for imparting the easily quick processing to the silver halide photographic material have been positively made. As to the increase of the easiness and quickening of processing, by the progress of an easy quick processing system as shown in a mini-laboratory system, print photographs having a very high image quality have been supplied relatively easily, in a short time, and at a low cost. Furthermore, by using a silver halide emulsion having a high content of silver chloride, it has been made to greatly shorten the processing time and to improve the processing deviation.

As a means for improving the sharpness of a silver halide photographic material having a reflective support, various means have hitherto been known. Examples of the means are 1) the prevention of irradiation by the use of a water-soluble dye; 2) the halation prevention by the use of colloidal silver, a mordant dye, a solid fine granular dye, etc.; 3) the increase of the filling ratio of a white pigment in the laminated resin on a paper support, etc. The dye being used for the purposes is, as a matter of course, required to not give bad influences on the photographic properties such as fog, etc., and is required to quickly be decolored in the photographic processing steps. Furthermore, it is preferred that the dye is completely decomposed in a processing liquid and does not give bad influences such as coloring, etc., to the processing liquid.

As the dyes meeting the aforesaid condition, the pyrazoloneoxonol dyes described, e.g., in British Patent 1,338,799, JP-A-63-264745, JP-A-1-196033, JP-A-2-93534, and JP-A-2-97940 have been found.

However, since the dyes are insufficient in water solubility and the molecular weight thereof is increased owing to the dissociative group bonded thereto, there is a problem that the diffusing property in the photographic layers is low, whereby a sufficient decoloring property is not obtained.

It is disclosed in JP-A-3-156452 (the term "JP-A" as used herein means an "unexamined published Japanese patent application") that the sharpness of a silver halide photographic material is greatly improved by increasing the content of a white pigment in a waterproof resin coated layer at the light-sensitive layer coated side of a reflective support. Furthermore, JP-A-4-256948, etc., disclose a reflective support having two or more polyolefin layers each having a different content of a white pigment. It has been found that by the foregoing constitution, the amount of a white pigment can be reduced while keeping the sharpness of the silver halide photographic material, which is advantageous in cost.

Also, EP 0,507,489(A1) discloses a reflective support using polyester in place of a polyolefin as the waterproof resin forming the coated layer and laminated with a mixed composition of the polyester and a white pigment. It has been found that in the case of using the laminate of the mixed composition of the polyester and a white pigment, the content of a white pigment is more increased as compared with the case of using a polyolefin as the waterproof resin and that the laminate is very effective for improving the sharpness of the silver halide photographic material.

However, there occurs a new problem that when a pressure such as a scratch, etc., is applied to the silver halide photographic material using the support wherein the content of a white pigment in the waterproof resin coated layer thereof is increased, a fog is liable to form at the pressed portions. Also, it has been found that the problem becomes more serious in a silver halide emulsion having a very high content of silver chloride.

SUMMARY OF THE INVENTION

The object of the present invention is, therefore, to provide a silver halide photographic material excellent in developing property and to provide a reflective-type photographic light-sensitive material having a high content of silver chloride capable of quickly providing a photograph having a high image quality at a low cost, said photographic light-sensitive material being excellent in sharpness, having a high sensitivity, and not causing fog, etc., even when a pressure is applied to the photographic light-sensitive material, and also to provide an image-forming process capable of quickly forming a photograph having a high image quality by using the foregoing reflective-type photographic light-sensitive material.

The object described above can be attained by the following silver halide photographic material of the present invention and the following image-forming process of the present invention.

That is, the present invention is as follows.

(1) A silver halide photographic material having on a reflective support at least one light-sensitive layer containing silver halide emulsion grains, wherein said reflective support has at least one waterproof resin coated layer which contains at least 2 g/m$^2$ of a white pigment in waterproof resin coated layer at the light-sensitive layer coated side and further at least one light-sensitive layer contains at least one compound represented by following general formula (I) in a molecular dispersion state of a monomolecule or a dimer;

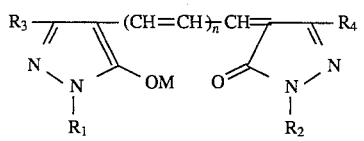

(I)

wherein $R_1$ to $R_4$ each represent a hydrogen atom or a substituent, the sum total of the atomic weights of at least one of ($R_1$+$R_3$) and ($R_2$+$R_4$) being not more than 160; n represents 0, 1, or 2; and M represents a hydrogen atom or an alkali metal.

(2) A silver halide photographic material of foregoing (1), wherein the substituents $R_1$, $R_2$, $R_3$, and $R_4$ of the general formula (I) do not have a dissociative group.

(3) A silver halide photographic material of foregoing (2), wherein the substituents $R_1$, $R_2$, $R_3$, and $R_4$ of the general formula (I) each are a hydrogen atom or a substituent selected from an alkyl group, —$COOR_5$, —$CONR_6R_7$, —$CONHR_8$, —$NR_9COR_{10}$, —$NR_{11}R_{12}$, —CN, —$OR_{13}$, and —$NR_{14}CONR_{15}R_{16}$, wherein $R_5$ to $R_{16}$ each represents a hydrogen atom or an alkyl group which may be substituted with a substituent having no dissociative group, and $R_6$ and $R_7$, $R_{11}$ and $R_{12}$, or $R_{15}$ and $R_{16}$ may form a ring.

(4) A silver halide photographic material of foregoing (1), wherein the compound shown by the general (I) is a compound represented by following general formula (II);

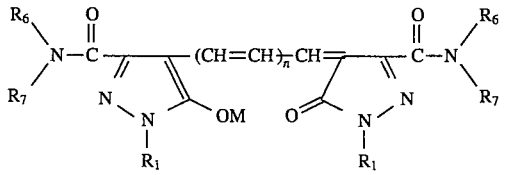

(II)

wherein $R_1$, $R_6$, and $R_7$ each represent a hydrogen atom or an alkyl group which may be substituted, the sum total of the atomic weights of $R_1$, $R_6$ and $R_7$ being not more than 120; n represents 0, 1, or 2; M represents a hydrogen atom or an alkali metal, and $R_6$ and $R_7$ may combine each other to form a hetero-ring.

(5) A silver halide photographic material of foregoing (4), wherein the substituents $R_1$, $R_6$, and $R_7$ of the general formula (II) do not have a dissociative group.

(6) A silver halide photographic material of foregoing (1) to (5), wherein said reflective support is composed of a base material and two or more waterproof resin coated layers formed thereon at the light-sensitive silver halide emulsion layer coated side, the waterproof resin coated layers each have a different content (weight %) of a white pigment.

(7) A silver halide photographic material of foregoing (6), wherein in the two or more waterproof resin coated layers each having a different content (weight %) of a white pigment, the content (weight %) of the white pigment in the waterproof resin coated layer nearest the base material is lower than that of the white pigment in at least one other waterproof resin coated layer at the light-sensitive silver halide emulsion layer coated side.

(8) A silver halide photographic material of foregoing (6), wherein in at least two waterproof resin coated layers each having a different content (weight %) of a white pigment, the content (weight %) of the white pigment in the waterproof resin coated layer nearest the light-sensitive layer is the highest.

(9) A silver halide photographic material of foregoing (6), wherein said reflective support has at least three waterproof resin coated layers each having a different content (weight %) of a white pigment and the content (weight %) of the white pigment in the intermediate layer(s) between the waterproof resin coated layer nearest the light-sensitive silver halide emulsion layer and the waterproof resin coated layer nearest the base material is the highest.

(10) A silver halide photographic material of foregoing (6) to (9), wherein the white pigment in the waterproof resin coated layers of the reflective support is titanium oxide and a weight ratio of the white pigment to the resin in the waterproof resin coated layer having the highest content (weight %) of the white pigment is 10/90 to 50/50 (titanium oxide/resin).

(11) A silver halide photographic material of foregoing (1) to (5), wherein the waterproof resin coated layers at the light-sensitive layer coated side of said reflective support have a composition prepared by mixing and dispersing titanium oxide in a resin composition comprised of a polyester synthesized by the condensation polymerization of a dicarboxylic acid and a diol, and the weight ratio of titanium oxide to the resin is 10/90 to 40/60 (titanium oxide/resin).

(12) A silver halide photographic material of foregoing (11), wherein the polyester of said reflective support is a polyester comprised of polyethylene terephthalate.

(13) A silver halide color photographic material of foregoing (1) to (12), wherein the light-sensitive silver halide emulsion layers on said reflective support are composed of at least three kinds of light-sensitive hydrophilic colloid layers each containing one of couplers each coloring to yellow, magenta, or cyan and silver halide emulsions which each provide a different color sensitivity and each have silver chloride content of at least 95 mole%.

(14) A silver halide photographic material having on a support at least one light-sensitive silver halide emulsion layer and at least one light-insensitive hydrophilic colloid layer, wherein at least one layer of said light-sensitive silver halide emulsion layer and said light-insensitive hydrophilic colloid layer contains a compound represented by the following general formula (II);

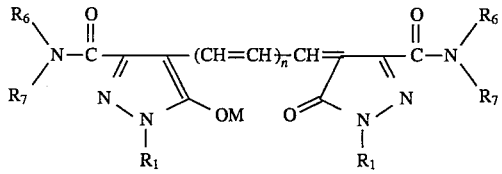

(II)

wherein $R_1$, $R_6$ and $R_7$ each represent a hydrogen atom or an alkyl group which may be substituted, the sum total of the atomic weights of $R_1$, $R_6$ and $R_7$ being not more than 120; n represents 0, 1 or 2; M represents a hydrogen atom or an alkali metal, and $R_6$ and $R_7$ may combine each other to form a hetero-ring.

(15) A color image forming process comprising printing the silver halide color photographic material described in foregoing (1) through a color negative film having a support composed of polyethylene terephthalate or polyethylene naphthalate.

(16) A color image forming process comprising light-exposing the silver halide color photographic material described in foregoing (1) by a scanning light-exposure system for a light-exposing time shorter than $10^{-4}$ second per one pixel and thereafter color processing the silver halide color photographic material.

DETAILED DESCRIPTION OF THE INVENTION

Then, the compound shown by the general formula (I) is explained in detail.

In the general formula (I) described above, it is necessary that the sum total of the atomic weights of at least ($R_1$+$R_3$) and ($R_2$+$R_4$) is not more than 160 and it is preferred that the sum total of the atomic weights of both ($R_1$+$R_3$) and ($R_2$+$R_4$) is not more than 160. Also, n is particularly preferred to be 1.

The substituents $R_1$, $R_2$, $R_3$, and $R_4$ each are preferably selected from a hydrogen atom, an alkyl group, —$COOR_5$, —$CONR_6R_7$, —$CONHR_8$, —$NR_9COR_{10}$, —$NR_{11}R_{12}$, —CN, —$OR_{13}$, and —$NR_{14}CONR_{15}R_{16}$ (wherein $R_5$ to $R_{16}$ each represents a hydrogen atom or an alkyl group which may be substituted and said $R_6$ and $R_7$, said $R_{11}$ and $R_{12}$, and said $R_{15}$ and $R_{16}$ may form a ring).

Furthermore, it is more preferred that the substituents $R_1$, $R_2$, $R_3$, and $R_4$ do not have a dissociative group.

The "dissociative group" described above is a substituent which is substantially dissociated in water of 25° C. and is a dissociative group having pKa of not higher than 12. Specific examples of such a dissociative group include a sulfonic acid group, a carboxy group, and a phosphoric acid group.

Furthermore, $R_1$ and $R_2$ each is preferably a hydrogen atom or an alkyl group. The alkyl group is preferably an alkyl group having from 1 to 3 carbon atoms such as methyl, ethyl, propyl, etc., and the alkyl group may have a substituent. As such a substituent, a substituent having an unshared electron pair, such as a hydroxy group, an ether group, an ester group, a carbamoyl group, a sulfonyl group, a sulfamoyl group, a cyano group, etc., is preferred and a hydroxy group and an ether group are particularly preferred.

The alkali metal shown by M is preferably Li, Na, K or Cs.

When $R_3$ and/or $R_4$ is an alkyl group, lower alkyl groups such as methyl, ethyl, propyl, butyl, etc., are preferred and methyl and ethyl are particularly preferred.

When $R_3$ and/or $R_4$ is shown by —$COOR_5$, the alkyl group shown by $R_5$ is preferably a lower alkyl group such as methyl, ethyl, propyl, butyl, etc., and methyl and ethyl are particularly preferred.

When $R_3$ and/or $R_4$ is shown by —$CONR_6R_7$, $R_6$ and $R_7$ may be a hydrogen atom or an alkyl group but it is preferred that at least one of $R_6$ and $R_7$ is an alkyl group. As the alkyl group, methyl, ethyl, propyl, etc., are preferred and the alkyl group may have a substituent. As the substituent, a hydroxy group or an ether group is preferred. Also, $R_6$ and $R_7$ may combine each other to form a ring and as the ring formed, a morpholine ring is particularly preferred.

When $R_3$ and/or $R_4$ is shown by —$CONHR_8$ and $R_8$ is an alkyl group, the alkyl group has the same meaning as the alkyl group shown by $R_6$ and $R_7$.

When $R_3$ and/or $R_4$ is shown by —$NR_9COR_{10}$, $R_9$ and $R_{10}$ may be a hydrogen atom or an alkyl group. As the alkyl group, methyl, ethyl, propyl, etc., are preferred and methyl is particularly preferred. The alkyl group may have a substituent and as the substituent, a hydroxy group and an ether group are preferred.

When $R_3$ and/or $R_4$ is shown by —$NR_{11}R_{12}$ or —$OR_{13}$, $R_{11}$, $R_{12}$, and $R_{13}$ may be a hydrogen atom or an alkyl group. As the alkyl group, methyl, ethyl, propyl, etc., are preferred and the alkyl group may have a substituent. As the substituent, a hydroxy group and an ether group are preferred. Also, $R_{11}$ and $R_{12}$ may combine each other to form a ring.

When $R_3$ and/or $R_4$ is shown by —$NR_{14}CONR_{15}R_{16}$, $R_{14}$, $R_{15}$, and $R_{16}$ may be a hydrogen atom or an alkyl group. As the alkyl group, methyl, ethyl, propyl, etc., are preferred and methyl is particularly preferred. Also, the alkyl group may have a substituent. As the substituent, a hydroxy group and an ether group are preferred.

In the substituents $R_3$ and $R_4$, —$CONR_6R_7$ is particularly preferred. $R_6$ and $R_7$ preferably combine each other to form a 5- or 6-membered ring. As the ring thus formed, there are a morpholine ring, a piperidine ring, a pyrrolidine ring, and a pyridazine ring but a morpholine ring is particularly preferred. The alkyl group represented by $R_1$ in the general formula (II) preferably includes methyl group and ethyl group, which may be substituted by a substituent such as cyano group and hydroxy group, but is particularly preferred to have no substituent.

It is preferred that the dye in the present invention exists in a molecular dispersion state of a monomolecule or a dimer. The molecular dispersion state is the state that the compound shown by the general formula (I) described above is uniformly dispersed in a silver halide emulsion layer or other hydrophilic colloid layer and when the dispersion state is observed by an electron microscope at a 100,000 magnification, substantially no solid is detected.

Then, specific examples of the compound shown by the general formula (I) being used in the present invention are illustrated below but the compound is not limited thereto.

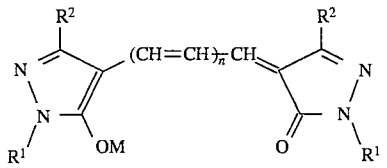

| | $R^1$ | $R^2$ | n | M |
|---|---|---|---|---|
| 1 | H | $CONHCH_2CH_2OH$ | 0 | K |
| 2 | H | $CON(CH_3)_2$ | 1 | K |
| 3 | H | 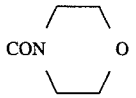 | 1 | K |
| 4 | $CH_3$ | $CONHCH_2CH_2OCH_3$ | 1 | K |
| 5 | $CH_2CH_3$ | $CONHCH_2CH_2OH$ | 1 | K |
| 6 | $CH_2CH_2OH$ | 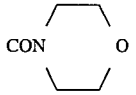 | 1 | K |
| 7 | $CH_2CH_2OH$ | $CONHCH_2CH_2OH$ | 0 | K |
| 8 | $CH_2CH_2OH$ | $CONHCH_3$ | 1 | K |
| 9 | H | $CONHCH_2CH_2OH$ | 1 | K |
| 10 | H | $CON(CH_3)_2$ | 2 | K |
| 11 | $CH_3$ | 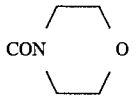 | 1 | Na |
| 12 | $CH_3$ | $CONHCH_2CH_2OCH_3$ | 2 | K |
| 13 | $CH_2CH_3$ | $CONHCH_2CH_2OH$ | 2 | K |
| 14 | $CH_2CH_2OH$ | 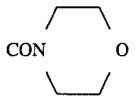 | 2 | K |
| 15 | $CH_2CH_2OH$ | $CONHCH_2CH_2OH$ | 2 | K |
| 16 | $CH_2CH_2OH$ | $CONHCH_3$ | 2 | K |
| 17 | H | $COOC_2H_5$ | 0 | K |
| 18 | H | $COOCH_3$ | 1 | K |
| 19 | $CH_3$ | $COOC_2H_5$ | 1 | Na |
| 20 | $CH_3$ | $COOCH_2CH_2OCH_3$ | 1 | K |
| 21 | $CH_2CH_3$ | $COOC_2H_5$ | 0 | K |
| 22 | $CH_2COOC_2H_5$ | $COOC_2H_5$ | 1 | K |
| 23 | $CH_2CH_2OH$ | $COOC_2H_5$ | 1 | K |
| 24 | H | $COOC_2H_5$ | 1 | K |
| 25 | H | $COOCH_3$ | 2 | K |
| 26 | $CH_3$ | $COOC_2H_5$ | 2 | K |
| 27 | $CH_3$ | $COOCH_2CH_2OCH_3$ | 2 | K |
| 28 | $CH_2CH_3$ | $COOC_2H_5$ | 2 | K |
| 29 | $CH_2COOC_2H_5$ | $COOC_2H_5$ | 2 | K |
| 30 | $CH_2CH_2OH$ | $COOC_2H_5$ | 2 | K |
| 31 | H | CN | 0 | K |
| 32 | H | CN | 1 | K |
| 33 | $CH_3$ | CN | 0 | K |
| 34 | $CH_3$ | CN | 1 | K |
| 35 | $CH_2CH_3$ | CN | 1 | K |
| 36 | $CH_2CH_3$ | CN | 2 | K |
| 37 | H | CN | 2 | K |
| 38 | $CH_3$ | CN | 2 | K |
| 39 | H | $CH_3$ | 1 | K |
| 40 | H | $CH_2CH_3$ | 1 | K |
| 41 | $CH_3$ | H | 1 | Na |
| 42 | $CH_3$ | $CH_3$ | 0 | K |
| 43 | $CH_2CH_2$ | $CH_3$ | 1 | K |
| 44 | $CH_2COOC_2H_5$ | $CH_3$ | 1 | K |
| 45 | $CH_2CH_2OH$ | $CH_3$ | 1 | K |

| | | | | |
|---|---|---|---|---|
| 46 | $CH_2CH_2OH$ | $CH_2CH_3$ | 1 | K |
| 47 | H | $CH_3$ | 2 | K |
| 48 | H | $CH_2CH_3$ | 2 | K |
| 49 | $CH_3$ | H | 2 | K |
| 50 | $CH_3$ | $CH_3$ | 2 | K |
| 51 | $CH_2CH_3$ | $CH_3$ | 2 | K |
| 52 | $CH_2COOC_2H_5$ | $CH_3$ | 2 | K |
| 53 | $CH_2CH_2OH$ | $CH_3$ | 2 | K |
| 54 | $CH_2CH_2OH$ | $CH_2CH_3$ | 2 | K |
| 55 | H | $OC_2H_5$ | 1 | K |
| 56 | H | $OC_2H_5$ | 2 | K |
| 57 | $CH_3$ | $OC_2H_5$ | 2 | K |
| 58 | $CH_3$ | OH | 1 | K |
| 59 | $CH_2CH_3$ | $OC_2H_5$ | 2 | K |
| 60 | $CH_2COOC_2H_5$ | $OC_2H_5$ | 2 | K |
| 61 | $CH_2CH_2OH$ | $OC_2H_5$ | 1 | K |
| 62 | $CH_2CH_2OH$ | $OC_2H_5$ | 2 | K |
| 63 | H | $OC_2H_5$ | 0 | K |
| 64 | H | $OCH_2CH_2OH$ | 1 | K |
| 65 | $CH_3$ | $OC_2H_5$ | 0 | K |
| 66 | $CH_3$ | OH | 2 | K |
| 67 | $CH_2CH_3$ | $OC_2H_5$ | 1 | K |
| 68 | $CH_2COOC_2H_5$ | $OC_2H_5$ | 1 | K |
| 69 | $CH_2CH_2OH$ | $OC_2H_5$ | 0 | K |
| 70 | $CH_2CH_2OH$ | $OCH_2CH_2OH$ | 1 | K |
| 71 | H | $NH_2$ | 0 | K |
| 72 | H | $NHCH_2CH_2OH$ | 1 | K |
| 73 | $CH_3$ | $NHCH_2CH_2OH$ | 0 | K |
| 74 | $CH_3$ | $NHCH_2CH_2OH$ | 1 | K |
| 75 | $CH_2CH_3$ | $NHCH_2CH_2OH$ | 1 | K |
| 76 | $CH_2COOC_2H_5$ | $NHCH_2CH_2OH$ | 1 | K |
| 77 | $CH_2CH_2OH$ | $NHCH_2CH_2OH$ | 0 | K |
| 78 | $CH_2CH_2OH$ | $NHCH_2CH_2OH$ | 1 | K |
| 79 | H | $NH_2$ | 1 | K |
| 80 | H | $NHCH_2CH_2OH$ | 2 | K |
| 81 | $CH_3$ | $NHCH_2CH_2OH$ | 2 | K |
| 82 | $CH_3$ | $NH_2$ | 1 | K |
| 83 | $CH_2CH_3$ | $NHCH_2CH_2OH$ | 2 | K |
| 84 | $CH_2COOC_2H_5$ | $NHCH_2CH_2OH$ | 2 | K |
| 85 | $CH_2CH_2OH$ | $NHCH_2CH_2OH$ | 2 | K |
| 86 | $CH_2CH_2OH$ | $NH_2$ | 1 | K |
| 87 | H | $NHCOCH_3$ | 1 | K |
| 88 | H | $NHCOCH_3$ | 2 | K |
| 89 | $CH_3$ | $NHCOCH_3$ | 1 | Na |
| 90 | $CH_3$ | $NHCOCH_3$ | 2 | K |
| 91 | $CH_2CH_3$ | $NHCOCH_3$ | 1 | K |
| 92 | $CH_2COOCH_3$ | $NHCOCH_3$ | 1 | K |
| 93 | $CH_2CH_2OH$ | $NHCOCH_3$ | 1 | K |
| 94 | $CH_2CH_2OH$ | $NHCOCH_3$ | 2 | K |
| 95 | H | $NHCONHCH_3$ | 0 | K |
| 96 | H | $NHCONHCH_3$ | 1 | K |
| 97 | $CH_3$ | $NHCONHCH_3$ | 0 | K |
| 98 | $CH_3$ | $NHCONHCH_3$ | 1 | K |
| 99 | $CH_2CH_3$ | $NHCONHCH_3$ | 1 | K |
| 100 | H | $NHCONHCH_3$ | 2 | K |
| 101 | H | $NHCON(CH_3)_2$ | 1 | K |
| 102 | $CH_3$ | $NHCONHCH_3$ | 2 | K |
| 103 | $CH_3$ | $NHCON(CH_3)_2$ | 2 | K |
| 104 | $CH_2CH_3$ | $NHCONHCH_3$ | 2 | K |

(105)

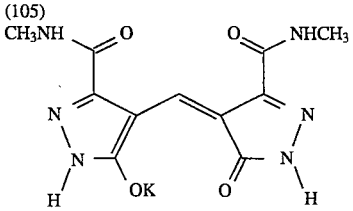

(106)

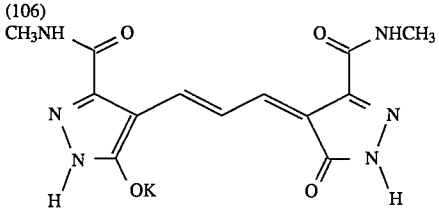

(107)

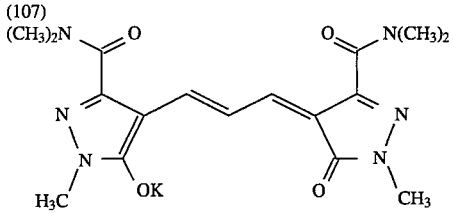

(108)

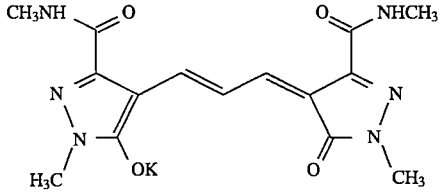

(109)

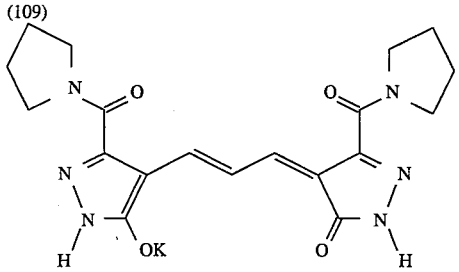

(110)

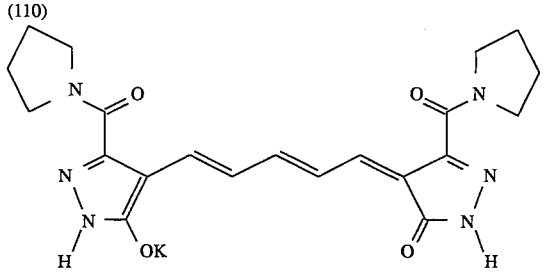

(111)

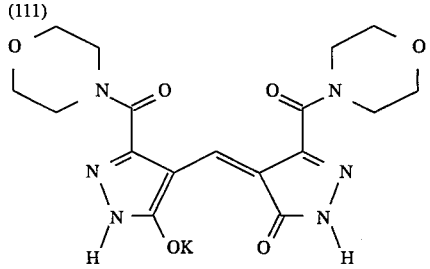

(112)

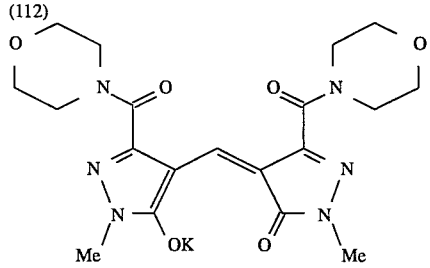

(113)

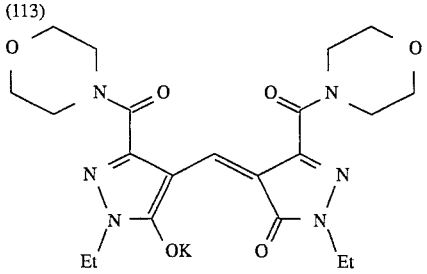

(114)

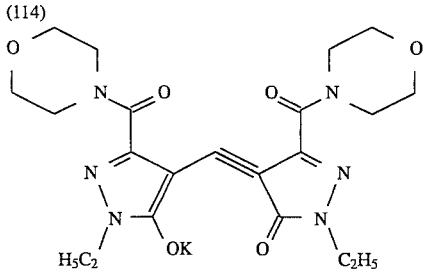

(115)

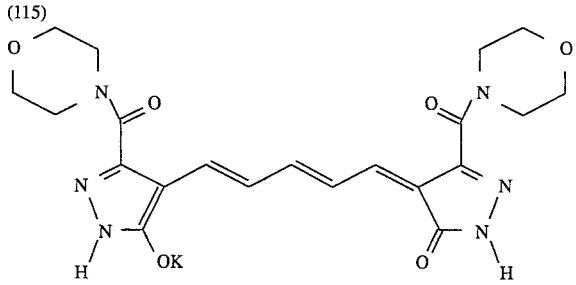

(116)

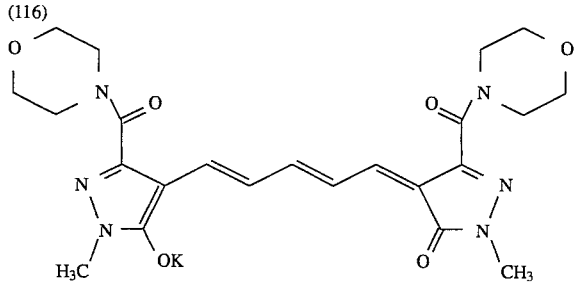

(117)

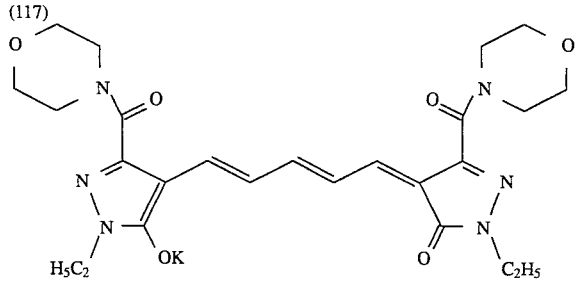

(118)

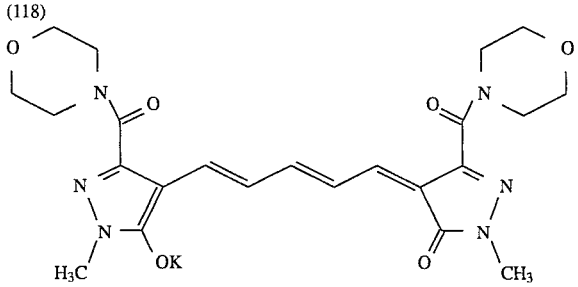

The compound shown by the general formula (I) being used in the present invention can be molecular dispersed in a light-sensitive layer or light-insensitive layer by various known methods. That is, there are a method of directly dispersing the compound in a light-sensitive layer or a light-insensitive layer, a method of dissolving the compound in a proper solvent (e.g., methanol, ethanol, propanol, methyl cellosolve, the halogenated alcohols described in JP-A-48-9715 and U.S. Pat. No. 3,756,830, acetone, water, pyridine, mixture thereof) and adding the compound in a form of the solution thereof, etc.

When the compound of the general formula (I) being used in the present invention is added to any of the light-sensitive layers and light-insensitive layers, the compound diffuses so as to be uniformly dispersed in the whole layers constituting the photographic light-sensitive material of the present invention.

There is no particular restriction in an amount of the compound represented by formula (I) being used in the present invention but is used in the range of preferably from 0.1 $mg/m^2$ to 200 $mg/m^2$, and particularly preferably from 1 $mg/m^2$ to 100 $mg/m^2$.

The compound shown by the general formula (II) can be synthesized by the reaction of the compound of the general formula (A) and a methine source as shown in following reaction formula 1.

Reaction Formula 1

Formula 1

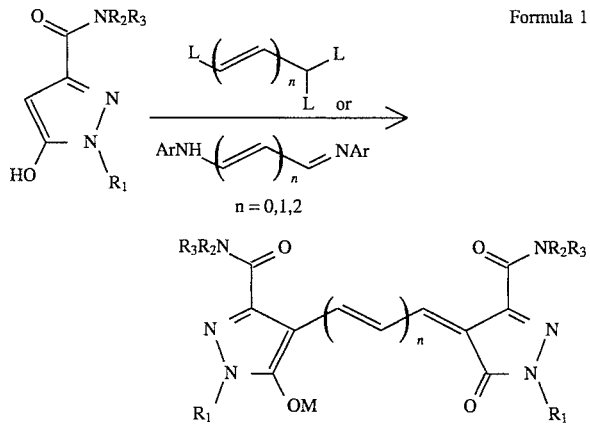

The compound shown by the general formula (A) is obtained by reacting an 3-alkoxycarbonyl-5-hydroxypyrazole synthesized from oxalacetic ester and hydrazine with a nitrogen-containing compound such as morpholine as shown in following reaction formula 2.

Reaction Formula 2

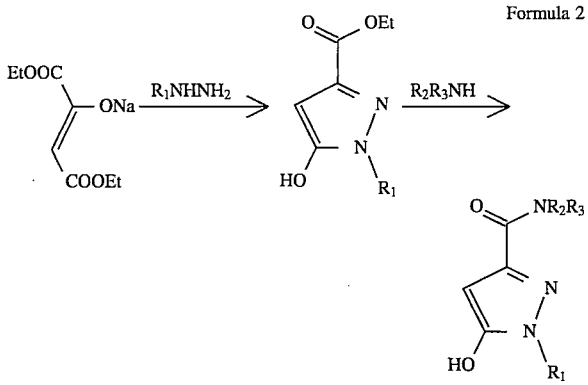

Formula 2

Specific examples of the pyrazole compound of the present invention are shown below.

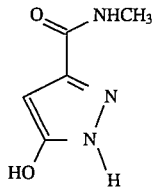

(A-1)

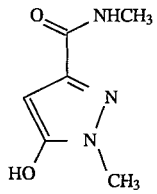

(A-2)

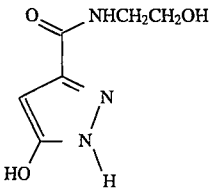

(A-3)

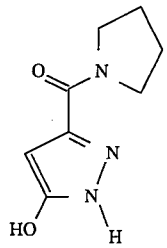

(A-4)

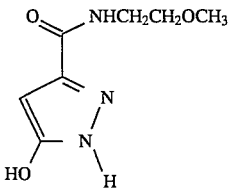

(A-5)

-continued

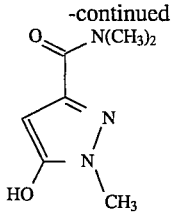

(A-6)

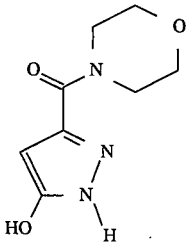

(C-1)

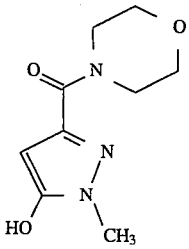

(C-2)

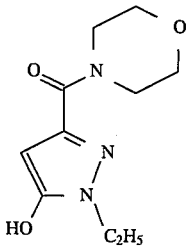

(C-3)

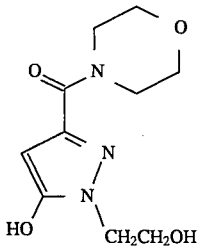

(C-4)

Then, the reflective support being used in the present invention is explained in detail.

It is necessary that the reflective support being used in the present invention contains at least 2 g/m$^2$ of a white pigment in total in the waterproof resin coated layer or layers at the light-sensitive layer coated side of the reflective support. If the content of the white pigment is less than 2 g/m$^2$, the sharpness of the photographic light-sensitive material is greatly reduced and the object of the present invention can not be attained. The content of the white pigment is preferably at least 3.0 g/m$^2$, and more preferably at least 4.0 g/m$^2$. There is no particular restriction on the upper limit of the white pigment but the content of the white pigment is preferably not more than 30 g/$m_2$ from the view point of cost.

As the white pigment being mixed and dispersed in the waterproof resin, there are inorganic pigments such as titanium dioxide, barium sulfate, lithophone, aluminum oxide, calcium carbonate, silicon oxide, antimony trioxide, titanium phosphate, zinc oxide, white lead, zirconium oxide, etc., and fine powders of an organic material such as polystyrene, a styrene-divinylbenzene copolymer, etc.

In these pigments, the use of titanium dioxide is particularly effective. Titanium dioxide may be of a rutile type or an anatase type but in the case of preceding the whitens, anatase-type titanium dioxide is preferably used and in the case of preceding the sharpness, rutile-type titanium dioxide is preferably used. For improving both the whiteness and the sharpness, a blend of anatase-type titanium dioxide and rutile-type titanium dioxide may be used. Furthermore, when the waterproof resin coated layer is composed of plural layers, a method of using anatase-type titanium dioxide for a certain layer and rutile-type titanium dioxide for other layer can be preferably employed. Also, titanium dioxide may be one produced by a sulfate method or a chloride method. Moreover, titanium dioxide being used in the present invention is also commercially available as KA-10, KA-20, etc., trade names, made by Titanium Kogyo K.K., and A-220, etc., trade name, made by Ishihara Sangyo Kaisha, Ltd.

Titanium dioxide being used in the present invention is preferably surface-treated with an inorganic material such as aluminum hydroxide, silicon hydroxide, etc.; an organic material such as a polyhydric alcohol, a polyvalent amine, a metal soap, an alkyl titanate, polysiloxane, etc.; or a combination of the inorganic material and the organic material, in order to restrain the activation of titanium dioxide to prevent the occurrence of yellowing. The amount of the surface-treating material is preferably from 0.2% by weight to 2.0% by weight to titanium dioxide for the inorganic material and from 0.1% by weight to 1.0% by weight to titanium dioxide for the organic material.

The mean particle size of titanium dioxide being used in this invention is preferably from 0.1 μm to 0.8 μm. If the mean particle size of titanium dioxide is less than 0.1 μm, it becomes undesirably difficult to uniformly mix and disperse it in the resin, while if the mean particle size if over 0.8 μm, a sufficient whiteness is not obtained and also projections are formed on the coated surface to give bad influences on the image quality formed.

In the present invention, it is preferred that the fine particles of the white pigment do not form aggregates, etc., of the particles in the reflective layer and are uniformly dispersed therein and the extent of the particle distribution can be obtained by measuring areal population (%) (Ri) of the fine particles projected onto a unit area. The coefficient of variation of the areal population (%) can be obtained by the ratio s/R of the standard deviation s of Ri to the average value (R) of Ri. In the present invention, the variation coefficient of the areal population (%) of the fine particles of the white pigment is preferably not higher than 0.15, more preferably not higher than 0.12, and particularly preferably not higher than 0.08.

The waterproof resin for the reflective support being used in the present invention is a resin having a water absorption (weight %) of not higher than 0.5, and preferably not higher than 0.1. Examples of the waterproof resin are polyolefins such as polyethylene, polypropylene, a polyethylene series polymer, etc.; a vinyl polymer and the copolymers thereof (e.g., polystyrene, polyacrylate, and the copolymers thereof), polyesters (polyethylene terephthalate, polyethylene isophthalate, etc.) and the copolymers thereof. In these resins, polyethylene and polyesters are particularly preferred.

As polyethylene, high-density polyethylene, low-density polyethylene, linear low-density polyethylene, and blend of these polyethylenes can be used. The melt flow rate (hereinafter, is referred to as MFR) of the polyethylene resin described above before working is in the range of preferably from 1.2 g/10 minutes to 12 g/10 minutes as the value measured under Condition 4 of Table 1 of JISK 7210. MFR of the polyolefin resin before working in the present invention is MFR of the resin before kneading therewith a bluing agent and the white pigment.

As the polyester, a polyester synthesized by the condensation polymerization of a dicarboxylic acid and a diol is preferred. As the dicarboxylic acid, there are terephthalic acid, isophthalic acid, naphthalenedicarboxylic acid, etc. Also, as the preferred diol, there are ethylene glycol, butylene glycol, neopentyl glycol, triethylene glycol, butanediol, hexylene glycol, a bisphenol A-ethylene oxide addition product [2,2-bis(4-(2-hydroxyethyloxy)phenyl)propane], 1,4-dihydroxymethylcyclohexane, etc.

Various polyesters obtained by condensation polymerization of the dicarboxylic acid singly or a mixture of these dicarboxylic acid and the diol singly or a mixture of these diols can be used in the present invention. In these polyesters, it is preferred that at least one kind of the dicarboxylic acids is terephthalic acid. Also, as the dicarboxylic acid component, a mixture of terephthalic acid and naphthalenedicarboxylic acid (mole ratio of from 9:1 to 2:8) or a mixture of terephthalic acid and naphthalenedicarboxylic acid (mole ratio of from 9:1 to 2:8) is preferably used.

Also, as the diol component, ethylene glycol or a mixed diols containing ethylene glycol is preferably used. The molecular weights of these polymers are preferably from 30,000 to 50,000.

Also, a mixture of these plural kinds of polyesters each having a different composition is preferably used. Furthermore, a mixture of the polyester(s) and other resin(s) can be preferably used. As the resin which can be used as the mixture with the polyester(s), resin which can be extruded at a temperature of from 270° C. to 350° C., for example, polyolefins such as polyethylene, polypropylene, etc.; polyethers such as polyethylene glycol, polyoxymethylene, polyoxypropylene, etc.; polyester series polyurethane; polyester series polyurethane; polycarbonate; and polystyrene can be widely used.

These resins being blended may be one kind of resin or two or more kinds of resins. For example, 6% by weight polyethylene and 4% by weight polypropylene can be mixed with 90% by weight polyethylene terephthalate.

The mixing ratio of the polyester and other resin(s) depends upon the kind of the other resin(s) to be mixed but when the other resin is a polyolefin, the mixing ratio of polyester/other resin is suitably from 100:0 to 80:20 by weight ratio. If the mixing ratio is over the range, the properties of the mixed resins are rapidly reduced. When the resin to be blended with the polyester is a resin other than the polyolefin, the mixing ratio of polyester/other resin is in the range of from 100:0 to 50:50 by weight ratio.

The ratio of the foregoing waterproof resin to the white pigment which is used in the whole waterproof resin layers of the photographic material of the present invention is from 98/2 to 30/70, preferably from 95/5 to 50/50, and particularly preferably from 90/10 to 60/40 (waterproof resin/white pigment) by weight ratio. If the mixing ratio of the white pigment is less than 2% by weight, the contribution to the whiteness is insufficient, if the mixing ratio is over 70% by weight, the surface smoothness as the support for the photographic light-sensitive material is insufficient, thereby a support for the photographic light-sensitive material excellent in surface gloss can not be obtained.

The waterproof resin layer(s) are coated on a base material at the light-sensitive layer coated side in a total thickness of preferably from 2 μm to 200 μm, and more preferably from 5 μm to 80 μm. If the thickness thereof is thicker than 200 μm, there occurs a problem in physical properties such that the resin becomes very brittle to cause cracks, etc. If the thickness thereof is thinner than 2 μm, the water proofing property, which is the fundamental object of the coating, is spoiled as well as it becomes impossible to simultaneously satisfy the whiteness and the surface smoothness of the support and also the resin layer becomes undesirably too soft in physical property.

In the silver halide photographic material of the present invention, the reflective support also has a resin layer at the back side (opposite side to the light-sensitive layer coated side) and the thickness of the resin or a resin composition being coated at the back side is preferably from 5 μm to 100 μm, and more preferably from 10 μm to 50 μm. If the thickness thereof is over the range, there occurs a problem in physical properties such that the resin becomes very brittle to cause cracks, etc. If the thickness is thinner than the range, the water proofing property, which is the fundamental object of the coating is spoiled and also the resin layer becomes undesirably too soft in physical property.

In the reflective support being used in the present invention, it is, as the case may be, preferable from the view points of cost, the production aptitude of the support, etc., that the waterproof resin coated layer at the light-sensitive layer coated side of the support is composed of two or more waterproof resin coated layers each having a different content of the white pigment. In this case, it is preferred that in the waterproof resin coated layers each having a different content of the white pigment, the content of the white pigment in the waterproof resin coated layer nearest the base material is lower than the content of the white pigment than at least one other waterproof resin coated layer disposed above the foregoing layer. As a more preferred embodiment, there is a reflective support wherein in the waterproof resin coated layers each having a different content of the white pigment, the content of the white pigment in the waterproof resin coated layer nearest the light-sensitive silver halide emulsion layer is the highest or a reflective support wherein the waterproof resin coated layers each having a different content of the white pigment are composed of at least three waterproof resin coated layers and the content of the white pigment in the intermediate layer or one of the intermediate layers between the waterproof resin coated layer nearest the light-sensitive silver halide emulsion layer and the waterproof resin coated layer nearest the base material.

In the multilayer waterproof resin coated layers, the content of the white pigment in each layer is from 0% by weight to 70% by weight, preferably 0% by weight to 50% by weight, and more preferably from 0% by weight to 40% by weight. The content of the white pigment in the layer having the highest content of white pigment of the multilayer waterproof resin coated layers is from 10% by weight to 70% by weight, preferably from 10% by weight to 50% by weight, more preferably from 15% by weight to 50% by weight and most preferably from 20% by weight to 40% by weight. If the content of the white pigment in the layer having the highest content of the white pigment is less than 9% by weight, the sharpness of the image formed is low, while if the content thereof is over 70% by weight, the film of the resin formed by melt extrusion causes cracks.

Also, the thickness of each layer of the multilayer waterproof resin coated layers is preferably from 0.5 μm to 50 μm. For example, in the case of the multilayer waterproof resin coated layers of a two-layer construction, the thickness of each layer is preferably from 0.5 μm to 50 μm and the total thickness of the layers is preferably in the foregoing range (i.e., 2 μm to 200 μm).

In the case of the multilayer waterproof resin coated layer of a three-layer construction, it is preferred that the thickness of the uppermost layer is from 0.5 μm to 10 μm, the thickness of the interlayer is from 5 μm to 50 μm, and the thickness of the lowermost layer (the layer nearest the base material) is from 0.5 μm to 10 μm. If the thickness of each of the uppermost layer and the lowermost layer is thinner than 0.5 μm, die lip stripes are liable to cause by the action of the white pigment highly filled in the interlayer.

On the other hand, if the thickness of each of the uppermost layer and the lowermost layer, in particular, the thickness of the uppermost layer is thicker than 10 μm, the sharpness of the photographic light-sensitive material is liable to lower.

The waterproof resin is mixed with the white pigment by kneading the white pigment in the resin by a kneading machine such as double rolls, three-rolls, a kneader, a bambury mixer, etc., using a metal salt of a higher fatty acid, a higher fatty acid ethyl ester, a higher fatty acid amide, a higher fatty acid, etc., as a dispersion aid. The amount of the dispersion aid is generally from about 0.5% by weight to 10% by weight to the white pigment. The resin layer(s) can contain an antioxidant and the proper content of the antioxidant is from 50 ppm to 100 ppm to the resin.

Also, it is preferred that the waterproof resin coated layer(s) contain a blueing agent. As the blueing agent, generally known materials such as ultramarine blue, cobalt blue, cobalt oxyphosphate, quinacridone series pigments, etc., and mixtures thereof are used.

There is no particular limitation on the particle sizes of the blueing agent but the particle sizes of commercially available blueing agents are usually from about 0.3 μm to 10 μm and the blueing agent having the particle sizes of the range can be used without any hindrance.

When the waterproof resin coated layer of the reflective support being used in the present invention is a multilayer structure, it is preferred that the content of the blueing agent in the uppermost waterproof resin coated layer is higher than the content of the blueing agent in the lower layer(s). In this case, it is preferred that the content of the blueing agent in the uppermost waterproof resin coated layer is from 0.2% by weight to 0.5% by weight and the content thereof in the lower layer is from 0 to 0.45% by weight.

The blueing agent is kneaded in the waterproof resin by a kneading machine such as double rollers, three-rollers, a kneader, a bambury mixer, etc. In this case, the blueing agent can be kneaded in the waterproof resin together with the white pigment. Also, for improving the dispersibility of the blueing agent, a dispersion aid such as a waterproof resin having a low molecular weight, a metal salt of a higher fatty acid, a higher fatty acid ester, a higher fatty acid amide, a higher fatty acid, etc., can be used.

As the method of forming the waterproof resin coated layers in the present invention, pellets containing the foregoing white pigment and/or the blueing agent are melted and, after, if necessary, diluting the molten pellets with a heat resisting resin followed by melting, are formed on a continuously travelling base material, e.g., a base paper such as a paper, a synthetic paper, etc., and a plastic film such as a polyester film (e.g., a polyethylene terephthalate film and a polybutylene terephthalate film), a polyolefin film (e.g., a polyester film, a triacetyl cellulose film, and a polypropylene film), etc., by a successive laminating method or a laminating method using a multilayer extruding die of a feed block type, a multimanifold type, or a multislot type. As the form of the die for multilayer extruding. a T die, a coat hanger die, etc., is general and there is no particular restriction on the form.

The outlet temperature at melt extrusion of the waterproof resin is usually from 270° C. to 350° C., and preferably from 300° C. to 330° C. Also, it is preferred to apply an activation treatment such as a corona discharging treatment, a flame treatment, a glow discharging treatment, etc., to the base material before coating the resin on the base material.

On the surface of the uppermost layer of the waterproof resin coated layers at the silver halide emulsion coating side of the reflective support can be applied marking of a gloss surface or marking of a fine surface, a matted surface or a silk surface described in JP-A-55-26507 and also on the back surface can be applied marking of a matt surface.

Also, it is preferred to apply an activation treatment such as a corona discharging treatment, a flame treatment, a plasma treatment, etc., onto the surface of the waterproof resin coated layer and further after the activation treatment, it is preferred to apply thereon a subbing treatment as described in JP-A-61-84643.

It is also preferred to coat a subbing liquid containing a compound represented by following general formula [U].

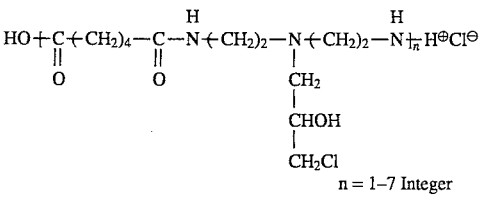

[U]

n = 1–7 Integer wherein n is an integer of from 1 to 7.

The coating amount of the compound shown by the general formula [U] is preferably at least 0.1 mg/m$^2$, more preferably at least 1 mg/m$^2$, and most preferably at least 3 mg/m$^2$. If the coating amount of the compound is larger, the adhesive force can be more increased but the use of an excessive amount of the compound is disadvantageous in cost.

Also, for improving the coating aptitude of the subbing liquid, it is preferred to add an alcohol such as methanol, etc., to the subbing liquid. In this case, the content of the alcohol is preferably at least 20% by weight, more preferably at least 40% by weight, and most preferably at least 60% by weight.

Also, for further improving the coating aptitude of the subbing liquid, it is preferred to add thereto various kinds of surface active agents such as an anionic surface active agent, a cationic surface active agent, an amphoteric surface active agent, a nonionic surface active agent, a fluorocarbon series surface active agent, an organosilicon series surface active agent, etc.

Also, for obtaining a good subbing coated surface form, it is preferred to add a water-soluble high molecular material such as gelatin, etc., to the subbing liquid.

For the stability of the compound shown by the general formula [U], pH of the subbing liquid is preferably from 4 to 11, and more preferably from 5 to 10.

It is more preferred to apply the surface activation treatment as described above to the surface of the waterproof resin coated layer before coating thereon the foregoing subbing liquid.

The subbing liquid can be coated by a generally well-known coating method such as gravure coating method, a bar coater coating method, a dip coating method, an air knife coating method, a curtain coating method, roller coating method, a doctor coating method, an extrusion coating method.

The drying temperature of the coating is preferably from 30° C. to 100° C., more preferably from 50° C. to 100° C., and most preferably from 70° C. to 100° C. The upper limit of the drying temperature is determined by the heat resistance of the resin and the lower limit thereof is determined by the efficiency of productivity.

As the base material being used for the reflective support in the present invention, a natural pulp paper composed of a natural pulp as the main raw material, a paper made from a mixture of a natural pulp and synthetic fibers, a synthetic fiber paper composed of synthetic fibers as the main component, a so-called synthetic paper, that is, a peudopaper-like synthetic resin film of polystyrene, polypropylene, etc., a plastic film such as a polyester film (e.g., a polyethylene terephthalate film and a polybutylene terephthalate film), a polyolefin film (e.g., a triacetyl cellulose film, a polystyrene film, and polypropylene film), etc., are used. Of them, as the base material for photographic waterproof resin coating, a natural pulp paper (hereinafter, is referred to simply as a base paper) is particularly advantageously used.

Various additives can be added to the base paper and as such additives, there are fillers such as clay, talc, calcium carbonate, fine particles of a urea resin, etc.; sizes such as rosin, an alkylketene dimer, a higher fatty acid, an epoxidated fatty acid amide, paraffin wax, an alkenylsuccinic acid, etc.; paper strength reinforcing agents such as starch, polyamidopolyamine epichlorohydrin, polyacrylamide, etc.; fixing agents such as aluminum sulfate, a cationic polymer, etc. If necessary, other additives such as dyes, fluorescent dyes, slime controlling agents, defoaming agents, etc., are added thereto. Also, if necessary, the following softeners can be added to the base paper.

The softeners are described, e.g., in *Shin Kami Kako Binran* (*New Paper Working Handbook*), pages 554 to 555 (published by Shiyaku Times K.K., 1980). In particular, the softeners having a molecular weight of at least 200 are preferred. That is, the softener has a hydrophobic group having at least 10 carbon atoms and an amine salt or a quaternary ammonium salt self-fixing with cellulose. Practically, there are a reaction product of a maleic anhydride copolymer and a polyalkylenepolyamine, a reaction product of a higher fatty acid and a polyalkylenepolyamine, a reaction product of urethane alcohol and an alkylating agent, a quaternary ammonium salt of a higher fatty acid, etc., but the reaction product of a maleic anhydride copolymer and a polyalkylenepolyamine and the reaction product of urethane alcohol and an alkylating agent are particularly preferred.

Onto the surface pulp can be applied a surface sizing treatment with a film-forming polymer such as gelatin, starch, carboxymethyl cellulose, polyacrylamide, polyvinyl alcohol, a denatured product of polyvinyl alcohol, etc.

As the denatured product of polyvinyl alcohol described above, there are a carboxy group-denatured product, a silanol-denatured product, a copolymer with acrylamide, etc.

Also, in the case of surface sizing treatment with a film-forming polymer, the coating amount of the film-forming polymer is from 0.1 g/m$^2$ to 5.0 g/m$^2$, and preferably from 0.5 g/m$^2$ to 2.0 g/m$^2$. Furthermore, in this case, the film-forming polymer may contain, if necessary, an antistatic agent, a fluorescent brightening agent, a pigment, a defoaming agent, etc.

The base paper is produced by making paper using a pulp slurry containing the foregoing pulp together with, if necessary, a filler, a size, a paper strength reinforcing agent, a fixing agent, etc., by a paper machine such as a Fourdrinier paper machine, drying, and winding. In this case, it is preferred that before or after drying the paper, the foregoing surface sizing treatment is applied and also between after drying and winding, calendering treatment is applied. When the surface sizing treatment is applied after drying, the calendaring treatment can be practiced before or after the surface sizing treatment but it is preferred that the calendaring treatment is practiced at the final finishing step after practicing various treatments. In the calendaring treatment, known metal rolls and elastic rolls being used for the production of ordinary papers are used.

There is no particular restriction on the thickness of the base paper as the support being used in the present invention but it is preferred that the basis weight of the base paper is from 50 g/m$^2$ to 250 g/m$^2$ and the thickness thereof is from 50 μm to 250 μm.

On the support being used in the present invention can be coated various back coatings for a static prevention, a curing prevention, etc. Also, the back coating layer can contain the inorganic antistatic agents, organic antistatic agents, hydrophilic binders, latexes, curing agents, pigments, surface active agents, etc., described or illustrated in JP-B-52-18020, JP-B-57-9059, JP-B-57-53940, JP-B-58-56859 (the term "JP-B" as used herein means an "examined published Japanese patent application"), JP-A-59-214849, JP-A-58-184144, etc., as a proper combination of them.

The photographic support having an excellent smoothness of the surface at the light-sensitive silver halide emulsion coated side is preferred. The "smoothness" is shown by the measure of the surface roughness of the support.

Then, the surface roughness of the support being used in the present invention is explained. As the surface roughness, the center line average surface roughness is used as the measure. The center line average surface roughness is defined as follows. That is, a part of an area SM is sampled on the center line from the rough curved surface, when crossed coordinate axes, X axis and Y axis are formed on the center line of the sampled portion and the axis perpendicular to the center line is defined as a Z axis, the value shown by the following formula is defined as the central line average surface roughness (SRa) and shown by a unit of μm.

$$SRa = \frac{1}{SM} \int_0^{L_X} \int_0^{L_Y} |f(X,Y)| d \times dY$$

$$L_X \cdot L_Y = SM$$
$$Z = f(X,Y)$$

The values of the center line average surface roughness and the heights of the projections from the center line can be obtained by measuring the area of 5 mm$^2$, using, for example, a three-dimentional surface roughness measuring apparatus (SE-30H, trade name, manufactured by Kosaka Kenkyusho K.K.) with a diamond needle having a diameter of 4 μm, at a cut off value of 0.8mm, at 20 magnifications in the horizontal direction and at 2,000 magnification in the height direction. Also, in this case, the moving speed of the measuring needle is preferably about 0.5 mm/second.

The value of the support obtained by the measurement described above is preferably not larger than 0.15 μm, and more preferably not larger than 0.10 μm. By using the support having such a surface roughness (smoothness), a color pring having an excellent surface smoothness is obtained.

The constitution of the photographic light-sensitive material of the present invention can be applied to various silver halide photographic materials using reflective supports. For example, the color photographic light-sensitive material of this invention can be constituted by coating at least one yellow-coloring silver halide emulsion layer, at least one magenta-coloring silver halide emulsion layer, and at least one cyan-coloring silver halide emulsion layer on a reflective support.

In a general color photographic printing paper, a color reproduction by a subtractive color process can be performed by using color couplers each forming a dye in a complementary color relation with light sensitive to each silver halide emulsion layer. In a general color photographic printing paper, the silver halide grains in the yellow-coloring silver halide emulsion layer, the magenta-coloring silver halide emulsion layer, and the cyan-coloring silver halide emulsion layer are each spectrally sensitized with a blue-sensitive spectral sensitizing dye, a green-sensitive spectral sensitizing dye, and a red-sensitive spectral sensitizing dye, respectively and these silver halide emulsion layers thus spectrally sensitized are coated on the reflective support in this order. Also, in a reversal color photographic paper, the silver halide grains in the foregoing coloring silver halide emulsion layers in the order described above are each spectrally sensitized with a blue-sensitive spectral sensitizing dye, a green-sensitive spectral sensitizing dye, and a red-sensitive spectral sensitizing dye, respectively, and these emulsion layers are coated on a support in the order of the red-sensitive emulsion layer, the green-sensitive emulsion layer, and the blue-sensitive emulsion layer. However, other disposition order of the color-sensitive silver halide emulsion layers may be employed. That is, from the view point of quick processing, it is preferred, as the case may be, that the light-sensitive silver halide emulsion layer containing silver halide grains having the largest mean grain size is disposed as the uppermost layer and also from the view point of the storage stability under light irradiation, it is preferred, as the case may be, that the magenta-coloring silver halide emulsion layer is dispersed as the lowermost layer.

Also, the light-sensitive silver halide emulsion layer may not have the foregoing correspondence with the coloring hue and further, at least one infrared sensitive silver halide emulsion layer may be used. Also, the light-sensitive silver halide emulsion layer may be composed of plural silver halide emulsion layers. Also, in the photographic light-sensitive material of the present invention, a light-insensitive layer is formed between the light-sensitive silver halide emulsion layer and the support, between the light-sensitive emulsion layer and the light-sensitive emulsion layer, and on upper light-sensitive emulsion layer (the farthest layer from the support) for various purposes such as a color mixing prevention, an irradiation/halation prevention, a light filter, the protection of the light-sensitive emulsion layer, etc.

Also, in the case of a black and white photographic printing paper, the light-sensitive material is constituted by forming at least one silver halide emulsion layer which is spectrally sensitized or is not spectrally sensitized in a panchromatic or orthochromatic region on the support.

In the silver halide photographic material of the present invention, silver chloride, silver bromide, silver chlorobromide, silver iodobromide, silver chlorobromide, silver chloroiodo-bromide, etc., can be used as the silver halide grains but for the purpose of quickening and simplifying photographic processing, a silver chlorobromide emulsion is preferred. For the silver chlorobromide emulsion, silver chloride grains or silver chlorobromide or silver chloroiodobromide grains having at least 95 mole % silver chloride can be preferably used. In particular, for quickening the photographic processing time, silver chlorobromide or silver chloride containing substantially no silver iodide. In the case, the term "containing substantially no silver iodide" means the content of silver iodide is not more than 1 mole %, and preferably not more than 0.2 mole %.

On the other hand, for the purposes of increasing a high irradiation sensitivity, increasing a spectral sensitizing sensitivity, or increasing the stability of the photographic light-sensitive material with the passage of time, the high silver chloride emulsion containing from 0.01 to 3 mole % silver iodide on the surface of the emulsion as described in JP-A-3-84545 is, as the case may be, preferably used.

The halogen composition of the silver halide emulsion being used in the present invention may be different or same among the silver halide grains and when the silver halide emulsion containing silver halide grains having the same halogen composition among the grains is used, the property of the silver halide grains can be easily homogenized. Also, as to the halogen composition distribution in the insides of the silver halide grains, so-called uniform type silver halide grains wherein the halogen composition is same in any portions of the silver halide grains, so-called laminated layer type silver halide grains wherein the halogen composition in the core in the insides of the silver halide grains differs from the halogen composition in the shell (single layer or plural layers) surrounding the core, or the silver halide grains of the structure having non-layer like portions having a different halogen composition in the insides or the surfaces of the silver halide grains (in the case of having such portions on the surfaces of the silver halide grains, the structure that the portions having the different halogen composition join to the edges, the corners, or the surfaces of the silver halide grains) can be properly used. For obtaining a high sensitivity, the use of the latter two kinds of the silver halide grains is more advantageous than the case of using the uniform type silver halide grains and is also preferred from the point of the pressure resistance.

When the silver halide grains have the structure as described above, the boundary portion between the portions each having a different halogen composition may be a clear boundary, an indistinct boundary forming mixed crystals by the difference of the halogen composition, or the boundary positively having a continuous change of structure.

In the high-silver chloride emulsion being used in the present invention, the silver halide grains of the structure having the local phases of silver bromide in the insides and/or the surfaces of the silver halide grains as layer form or a non-layer form as described above are preferred. The halogen composition of the foregoing local phases is preferably at least 10 mole %, and more preferably over 20 mole % in the content of silver bromide. The silver bromide content of the silver bromide local phases can be analyzed by using an X-ray diffraction method (e.g., described in *Shin Jikken Kagaku Koza* (*New Experimental Chemistry Course*) 6, "Koozou Kaiseki (Structure Analysis), published by Maruzen K.K.).

Also, these local phases can exist in the insides of the grains, or the edges of, the corners of, or on the surfaces of the grains but as one of preferred examples, there are epitaxially grown local phases at the corner portions of the silver halide grains.

Furthermore, for the purpose of reducing the replenishing amounts of the photographic processing liquids, it is effective to further increase the content of silver chloride in the silver halide emulsion. In such a case, the silver halide emulsion of almost pure silver chloride such as the silver halide content is from 98 mole % to 100 mole % is preferably used.

The mean grain size (the diameter of the circle equivalent to the projected area of the grain is defined as the grain size and the mean grain size is the number mean value of them) of the silver halide grains contained in the silver halide emulsion being used in the present invention is preferably from 0.1 μm to 2 μm.

Also, the grain size distribution of the silver halide grains is preferably of a so-called mono-disperse type that the coefficient of variation (the standard deviation of the grain size distribution divided by the mean grain size) is not more than 20%, preferably not more than 15%, and more preferably not more than 10%. In this case, for obtaining a wide latitude, it is preferably practiced that the foregoing so-called monodisperse silver halide emulsions are blended in one layer or are coated as multilayers.

The form of the silver halide grains contained in the photographic silver halide emulsion being used in the present invention may be a regular crystal form such as cubic, tetradecahedral, or octahedral, an irregular crystal form such as spherical, tabular, etc., or a composite form thereof. Also, a mixture of the silver halide grains having various crystal forms may be used. In the present invention, the silver halide grains having at least 50%, preferably at least 70%, and more preferably at least 90% the grains having the foregoing regular crystal form are preferably used.

Also, in addition to the silver halide emulsions described above, a silver halide emulsion containing silver halide grains wherein tabular silver halide grains having an average aspect ratio (circle-converted diameter/thickness) of at least 5, and preferably at least 8 account for at least 50% of the total grains can be preferably used in the present invention.

The silver chloro(bromide) emulsion for use in this invention can be prepared using the methods described in P. Glafkides, *Chimie et Physique Photographique*, (published by Paul Montel Co., 1967), G. F. Duffin, *Photographic Emulsion Chemistry*, (published by Focal Press Co., 1966), V. L. Zelikman et al, *Making and Coating Photographic Emulsion*, (published by Focal Press Co., 1964), etc.

That is, the emulsion can be prepared by an acid method, a neutralization method, an ammonia method, etc., and as a system of reacting a soluble silver salt and a soluble halide, a single jet method, a double jet method, or a combination thereof may be used. A so-called reverse mixing method of forming silver halide grains in the existence of excess silver ions can be also employed. As one system of the double jet method, a so-called controlled double jet method of keeping a constant pAg in a liquid phase of forming silver halide grains can be used. According to the method, a silver halide emulsion containing silver halide grains having a regular crystal form and substantially uniform grain sizes can be obtained.

It is preferred that the local phases or the substrate thereof of the silver halide grains being used in this invention contains a foreign metal ion or the complex ion thereof. The preferred metal is selected from the ions of the metals belonging to group VIII and group IIb of the periodic table or the metal complexes thereof, a lead ion, and a thallium ion. For the local phases, the metal ion selected from iridium, rhodium, iron, etc., or the complex ions thereof can be mainly used as a combination thereof and for the substrate, the metal ion selected from osmium, iridium, rhodium, platinum, ruthenium, palladium, cobalt, nickel, iron, etc., or the complex ions thereof can be mainly used as a combination thereof. Also, the kind and the concentration of the metal ion(s) can be changed between the local phases and the substrate. These metals may be used as a mixture of plural kinds thereof. In particular, it is preferred that iron and an iridium compound exist in the local phases of silver bromide.

The compounds for supplying these metal ions are contained in the local phases and/or other grain portions (substrate) of the silver halide grains for use in this invention by adding the compounds to an aqueous gelatin solution, which becomes a dispersion medium, an aqueous halide solution, an aqueous silver salt solution, or other aqueous solution at the formation of the silver halide or a means of adding the form of silver halide fine grains previously containing the metal ion(s) to the above-described solution and dissolving the fine grains.

The metal ion(s) being used in this invention can be contained in the silver halide grains before, during, or after the formation of the silver halide grains. The step of adding the metal ion(s) can be changed according to the positions of the silver halide grains in which the metal ion(s) are contained.

The silver halide emulsion being used in the present invention is usually subjected to a chemical sensitization and a spectral sensitization.

As the chemical sensitizing method, a chemical sensitization using a chalcogen sensitizer (practically, a sulfur sensitization by the addition of a unstable sulfur compound, a selenium sensitization with a selenium compound, and a tellurium sensitization with a tellurium compound), a noble metal sensitization such as a gold sensitization, and a reduction sensitization can be used singly or as a combination thereof.

As compounds being used for the chemical sensitization, the compounds described in JP-A-62-215272, pages 18, right lower column to page 22, right upper column are preferably used.

The effect of the constitution of the photographic light-sensitive material of the present invention is more remarkable in the case of using a high-silver chloride emulsion subjected to a gold sensitization.

The silver halide emulsion for use in this invention is a so-called surface latent image-type silver halide emulsion forming a latent image mainly on the surfaces of the silver halide grains.

To the silver halide emulsions for use in this invention can be added various compounds or the precursors thereof for preveing the formation of fog during the production, the storage, and/or photographic processing of the photographic light-sensitive material or for stabilizing the photographic performance thereof. As such compounds, the compounds described in JP-A-62-215272, pages 39 to 72 are preferably used. Furthermore, the 5-arylamino-1,2,3,4-thiatriazole compounds (said aryl reside has at least one electron attrative group) described in EP 447,647 are also preferably used.

The spectral sensitization is carried out for imparting a spectral sensitivity to the desired wavelength region of the silver halide emulsion of each emulsion layer of the photographic light-sensitive material of this invention.

As the spectral sensitizing dyes being used for the spectral sensitizations of blue, green, and red regions in the photographic light-sensitive material of this invention, the dyes described, e.g., in F. M. Harmer, *Heterocyclic Compounds-Cyanine Dyes and Related Compounds*, (published by John Wiley & Sons [New York, London], 1964) can be used.

Examples of the practical compound and the spectral sensitizing method are described in JP-A-62-215272 described above, page 22, right upper column to page 38 and they can be preferably used in this invention. Also, as a red-sensitive spectral sensitizing dye for silver halide grains having a particularly high silver chloride content, the spectral sensitizing dyes described in JP-A-3-123340 are very preferred from the view points of the stability, the strength of adsorption, the temperature reliance of light exposure, etc.

In the case of spectrally sensitizing the infrared region with a good efficiency in the photographic light-sensitive material of the present invention, the sensitizing dyes described in JP-A-3-15049, page 12, left upper column to page 21, left lower column, JP-A-3-20730, page 4, left lower column to page 15, left lower column, EP 0,420,011, page 4, line 21 to page 6, line 54, EP 0,420,012, page 4, line 12 to page 10, line 33, EP 0,443,466, and U.S. Pat. No. 4,975,362 are preferably used.

For incorporating these spectral sensitizing dyes in the silver halide emulsion, they may be directly dispersed in the emulsion or may be added as a solution thereof in a solvent such as water, methanol, ethanol, propanol, methyl cellosolve, 2,2,3,3-tetrafluoropropanol, etc., or a mixed solvent thereof. Also, the spectral sensitizing dye may be added to the silver halide emulsion as an aqueous solution thereof containing an acid or a base as described in JP-B-44-23389, JP-B-44-27555, JP-B-57-22089, etc., (the term "JP-B" as used herein means an "examined published Japanese patent application") or may be added to the emulsion as an aqueous solution or a colloid dispersion thereof containing a surface active agent as described in U.S. Pat. Nos. 3,822,135 and 4,006,025. Also, after dissolving the spectral sensitizing dye in a solvent substantially immiscible with water, such as phenoxy ethanol, etc., the solution is dispersed in water or a hydrophilic colloid and the dispersion may be added to the emulsion. Furthermore, the spectral sensitizing dye is directly dispersed in a hydrophilic colloid and the dispersion may be added to the emulsion as described in JP-A-53-102733 and JP-A-58-105141.

The time for adding the dye to the emulsion may be any step in the preparation of the emulsion, which is known to be useful. That is, the time for adding the dye can be selected from the steps of before and during the formation of the silver halide emulsion, the step of from directly after the formation of the silver halide grains to just before the water-washing step, the steps of before and during the chemical sensitization of the emulsion, the steps of from directly after the chemical sensitization to caking the emulsion by cooling, and the step of preparing the coating liquid of the emulsion. Usually, the addition of the dye is performed after finishing the chemical sensitization before coating the emulsion. Also, the spectral sensitizing dye is added to the emulsion together with a chemical sensitizer and the spectral sensitization and the chemical sensitization can be carried out simultaneously as described in U.S. Pat. Nos. 3,628,969 and 4,225,666, the spectral sensitization can be performed before the chemical sensitization as described in JP-A-58-113928, and also the spectral sensitizing dye may be added before finishing the formation of the precipitates of the silver halide grains to initiate the spectral sensitization.

Furthermore, as described in U.S. Pat. No. 4,225,666, a part of the spectral sensitizing dye is added before the chemical sensitization and the residue of the dye can be added after the chemical sensitization and further, the method described in U.S. Pat. No. 4,183,756 can be used and the addition of the dye may be any step during the formation of silver halide grains.

In these steps, it is particularly preferred to add the sensitizing dye before water-washing step of the emulsion or before the chemical sensitization of the emulsion.

The addition amount of the spectral sensitizing dye is in a wide range and is in the range of preferably from $0.5\times10^{-6}$ mole to $1.0\times10^{-2}$ mole, and more preferably from $1.0\times10^{-6}$ mole to $5.0\times10^{-3}$ mole per mole of the silver halide.

In the case of using the sensitizing dyes having spectral sensitizing sensitivities in a red region to an infra red region in the present invention, it is particularly preferred to use the dyes together with the compounds described in JP-A-2-157749, page 13, right lower column to page 22, right lower column. By using these compounds, the storage stability of the photographic light-sensitive material, the stability of processing, and the supersensitization effect can be greatly increased. In the foregoing compounds, the use of the compounds shown by the formulae (IV), (V) and (VI) in the above patent publication is particularly preferred. The compound is used in an amount of from $0.5\times10^{-5}$ mole to $5.0\times10^{-2}$ mole, and preferably from $5.0\times10^{-5}$ mole to $5.0\times10^{-3}$ mole per mole of the silver halide and also the advantageous using amount of the compound is in the range of from 0.1 times to 10,000 times, and preferably 0.5 times to 5,000 times per mole of the sensitizing dye.

The photographic light-sensitive material of the present invention is preferably used for a digital scanning light exposure using a monochromatic high-density light such as a gas laser, a light emitting diode, a semiconductor laser, or a second high-harmonic generating source (SHG) combining a semiconductor laser or a solid state laser using a semiconductor laser as the excitation light source and a nonlinear optical crystal in addition to the use for the printing system using an ordinary negative printer. For making the system compact and low cost, it is preferred to use a semiconductor laser or the second high-harmonic generating light source (SHG) combining a semiconductor laser or a solid state laser and a nonlinear optical crystal. In particular, for designing an apparatus which is compact, is low cost, has a longer life, and has a high stability, the use of a semiconductor laser is preferred and also it is desirable to use a semiconductor laser as one of the exposure light sources.

In the case of using such a scanning exposure light-source, the spectral sensitivity maximum of the photographic light-sensitive material of the present invention can be optionally selected according to the wavelength of the scanning exposure light source being used. Since in the SHG light source obtained by combining a solid state laser using a semiconductor laser as the exciting light source or a semiconductor laser and a nonlinear optical crystal, the oscillation wavelength of laser can be shortened to a half thereof, a blue light or a green light is obtained. Accordingly, it is possible to give the spectral sensitivity maximum of the photographic light-sensitive material in the ordinary three regions of blue, green, and red. For using a semiconductor laser as the light source for making the apparatus low cost, highly stable, and compact, it is preferred that at least two emulsion layers of the photographic light-sensitive material have the spectral sensitivity maximum for at least 670 nm. This is because the light emitting wavelength regions of inexpensive and stable group III-V series semiconductor lasers available at present and being low cost are in the regions of from red to infrared only. However, in an experimental level, the oscillation wavelength regions in green and blue regions of group II-VI series semiconductor lasers have been confirmed and when the production technique of semiconductor lasers is developed, it is sufficiently anticipated that these semiconductor lasers is used stably and at a low cost. In such a case, the necessity that at least two emulsion layers of the photographic light-sensitive material having the spectral sensitivity maximum at least 670 nm becomes less.

In such a scanning exposure, the time of exposing the silver halide in a photographic light-sensitive material is a time required for exposing a fine area thereof. As the fine area, the minimum unit of controlling the light intensity from each digital datum is generally used and is called as a pixel. Therefore, according to the size of the pixel, the exposure time per one pixel is changed. The size of the pixel depends on the pixel density and the actual range is from 50 to 2,000 dpi. When the exposure time is defined as the time for exposing the pixel size in the case that the pixel density is 400 dpi, the exposure time is preferably not longer than $10^{-4}$ second, and more preferably not longer than $10^{-6}$ second.

In the photographic light-sensitive material of the present invention, it is preferred to color the hydrophilic colloid layer for the purpose of preventing the irradiation and halation and of improving the safelight safety, etc. The compound of the general formula (I) being used in this invention can be also used as a coloring material and hence it is preferred to use the compound for the purposes of coloring and improving the pressure resistance. Also, as a water-soluble dye being used together with the foregoing compound of the general formula (I), there are the dyes (in particular, oxonol dyes and cyanine dyes) capable of being decolored by processing described in EP 0,337,490A2, pages 27 to 76.

Some of these water-soluble dyes deteriorate the color separation and the safelight safety if the using amount thereof is increased. As the dyes which can be used without deteriorating the color separation, there are the water-soluble dyes described in EP 0,539,978A1, Japanese Patent Application Nos. 3-310189 and 3-310039 and as the case may be, the use of the water-soluble dye together with the compound of this invention is preferred.

In the case of applying such coloring, the coloring material diffuses regardless the position of the added layer of the coloring material and diffuses in the whole layers constituting the photographic light-sensitive material. The coloring density is at least 0.2, preferably at least 0.3, and more preferably at least 0.5 at the light intensity maximum wavelength of the light source being used for the light exposure. In particular, it is preferred that the density of the absorption maximum of the colored range colored using the compound of this invention is at least 0.3.

In the present invention, the colored layer with the compound of this invention in place of the foregoing water-soluble dye or together with the water-soluble dye, said colored layer capable of being decolored in processing, is used. The colored layer capable of being decolored in processing, which is used in this invention, may be in directly contact with the silver halide emulsion layer or disposed in contact with the emulsion layer through an interlayer containing a processing color mixing inhibitor such gelatin and hydroquinone. It is preferred that the colored layer is disposed under (the support side) the silver halide emulsion layer coloring to the same kind of an elementary color as the colored color. Colored layers each corresponding to all elementary colors or may be disposed and colored layers each corresponding to a part of an optionally selected color may be also disposed. Further colored layers each corresponding to plural elementary colors may be disposed.

As to the optical reflective density of each of these colored layers, in the wavelength region to be used for exposure (a visible light region of from 400 nm to 700 nm in an ordinary printer exposure and the wavelength of the scanning exposure light source being used in the case of scanning exposure), the optical density at the wavelength of the highest optical density is preferably from 0.2 to 3.0, more preferably from 0.5 to 2.5, and particularly preferably from 0.8 to 2.0.

For forming the colored layer(s), a conventionally known method can be used. For example, there are a method of incorporating in a hydrophilic colloid layer as state of a solid fine particle dispersion as is seen in the dye described in JP-A-2-282244, page 3, right upper column to page 8 or the dye described in JP-A-3-7931, page 3, right upper column to page 11, left lower column, a method of mordanting a cation polymer with an anionic dye, a method of adsorbing a dye to the fine grains of a silver halide, etc., to fix the fine grains in the layer, and a method of using colloid silver as described in JP-A-1-239544.

As a method of dispersing the fine powder of a dye in a solid state, for example, a method of incorporating a fine-powdery dye which is substantially water-insoluble at pH of lower than 6 but is substantially water-soluble at pH of at least 8 is described in JP-A-2-308244, pages 4 to 13. Also, a method of mordanting a cation polymer with an anionic dye is described in JP-A-2-84637, pages 18 to 26. A method of preparing colloidal silver as a light absorbent is described in U.S. Pat. Nos. 2,688,601 and 3,459,563. Also, the use of tabular thin colloid silver particles having a thickness of thinner than 20 nm described in JP-A-5-134358 is preferred.

In the methods described above, the method of incorporating the fine powdery dye and the method of using colloid silver are preferred in this invention.

As a binder or a protective colloid which can be used for the photographic light-sensitive material of this invention, gelatin is advantageously used but other hydrophilic colloid can be used singly or together with gelatin. As preferred gelatin, low-calcium gelatin having a calcium content of not more than 800 ppm, and more preferably not more than 200 ppm is used. Also, for preventing the growth of various fungi and bacteria growing in the hydrophilic colloid layers to deteriorate the image quality, it is preferred to add the antifungal agents described in JP-A-63-271247.

At printer exposing the photographic light-sensitive material of the present invention, it is preferred to use the hand stop filter described in U.S. Pat. No. 4,880,726, whereby color mixing is removed and the color reproducibility is greatly improved.

The image-exposed color photographic light-sensitive material of this invention can be subjected to conventional color photographic processing but in the case of the color photographic light-sensitive material of this invention, it is preferred for the purpose of quick processing to subject the color photographic material to a blix (bleach-fix) processing after a color development. In particular, in the case of using the high-silver chloride emulsion(s) described above, pH of the blix solution is preferably lower than about 6.5, and more preferably lower than about 6 for the purpose of the desilvering acceleration, etc.

The silver halide emulsions and other elements (additives, etc.) being used for the photographic light-sensitive materials of this invention, the layers (disposition of layers, etc.) for constituting the photographic light-sensitive materials, and the processing methods and additives for processing the light-sensitive materials of this invention described in the following patent publications, in particular, EP 0,355,660A2 (JP-A-2-139544) are preferably used.

| Photographic elements | JP-A-62-215292 | JP-A-2-33144 | EP 0,355,660A2 |
|---|---|---|---|
| Silver halide emulsion | pp. 10, right upper colmn, line 6 to pp. 12, left lower colmn, line 5, and pp. 12, right lower colmn, line 4 from bottom to pp. 13, left upper colmn, line 17. | pp. 28, right upper colmn, line 16 to pp. 29, right lower colmn, line 11, and pp. 30, lines 2 to 5. | pp. 45, line 53 to pp. 47, line 3, and pp. 47, lines 20 to 22. |
| Silver halide solvent | pp. 12, left lower colmn, lines 6 to 14, and pp. 13, left upper colmn, line 3 from bottom to pp. 18, left lower colmn, last line. | — | — |
| Chemical sensitizer | pp. 12, left lower colmn, line 3 from bottom to right lower colmn, line 5 from bottom, and pp. 18, right lower colmn, line 1 to pp. 22, right upper colmn, line 9 from bottom. | pp. 29, right lower colmn, line 12 to last line. | pp. 47, lines 4 to 9. |
| Spectral sensitizer (spectral sensitizing process) | pp. 22, right upper colmn, line 8 from bottom to pp. 38, last line. | pp. 30, left upper colmn, lines 1 to 13. | pp. 47, lines 10 to 15. |
| Emulsion stabilizer | pp. 39, left upper colmn, line 1 to pp. 72, right upper colmn, last line. | pp. 30, left upper colmn, line 14 to right upper colmn, line 1. | pp. 47, lines 16 to 19. |
| Development accelerator | pp. 72, left lower colmn, line 1 to pp. 91, right upper colmn, line 3. | — | — |
| Color coupler (cyan, | pp. 91, right upper colmn, line 4 to pp. 121, left | pp. 3, right upper colmn, line 14 to pp. 18, left | pp. 4, lines 15 to 27, pp. 5, line 30 to pp. 28, |

-continued

| Photographic elements | JP-A-62-215292 | JP-A-2-33144 | EP 0,355,660A2 |
|---|---|---|---|
| magenta and yellow couplers) | upper colmn, line 6. | upper colmn, last line, and pp. 30, right upper colmn, line 6 to pp. 35 right lower colmn, line 11. | last line, pp. 45, lines 29 to 31, and pp. 47, line 23 to pp. 63, line. 50 |
| Color forming accelerator | pp. 121, left lower colmn, line 7 to pp. 125, right upper colmn, line 1. | — | — |
| UV absorber | pp. 125, right upper colmn, line 2 to pp. 127, left lower colmn, last line. | pp. 37, right lower colmn, line 14 to pp. 38, left upper colmn, line 11. | pp. 65, lines 22 to 31. |
| Anti-fading agent (an image stabilizer) | pp. 127, right lower colmn, line 1 to pp. 137, left lower colmn, line 8. | pp. 36, right upper colmn, line 12 to pp. 37, left upper colmn, line 19. | pp. 4, line 30 to pp. 5, line 23, pp. 29, line 1 to pp. 45, line 25, pp. 45, lines 33 to 40, and pp. 65, lines 2 to 21. |
| High boiling and/or low boiling organic solvent | pp. 137, left lower colmn, line 9 to pp. 144, right upper, last line. | pp. 35, right lower colmn, line 14 to pp. 36, left upper, line 4 from bottom. | pp. 64, lines 1 to 51. |
| Process for dispersing photographic additives | pp. 144, left lower colmn, line 1 to pp. 146, right upper colmn, line 7. | pp. 27, right lower colmn, line 10 to pp. 28, left upper, last line, and pp. 35, right lower colmn, line 12 to pp. 36, right upper colmn, line 7. | pp. 63, line 51 to pp. 64, line 56. |
| Hardener | pp. 146, right upper colmn, line 8 to pp. 155, left lower colmn, line 4. | — | — |
| Precursor of a developing agent | pp. 155, left lower colmn, line 5 to right lower colmn, line 2. | — | — |
| Development inhibitor-releasing compound | pp. 155, right lower colmn, lines 3 to 9. | — | — |
| Light-sensitive layer structure | pp. 156, left upper colmn, line 15 to right lower colmn, line 14. | pp. 28, right upper colmn, lines 1 to 15. | pp. 45, lines 41 to 52 |
| Dye | pp. 156, right lower colmn, line 15 to pp. 184, right lower colmn, last line. | pp. 38, left upper colmn, line 12 to right upper colmn, line 7. | pp. 66, lines 18 to 22. |
| Anti-color mixing agent | pp. 185, left upper colmn, line 1 to pp. 188, right lower colmn, line 3. | pp. 36, right upper colmn, lines 8 to 11. | pp. 64, line 57 to pp. 65 line 1. |
| Gradation controller | pp. 188, right lower colmn, lines 4 to 8. | — | — |
| Anti-stain agent | pp. 188, right lower colmn, line 9 to pp. 193, right lower colmn, line 10. | pp. 37, left upper colmn, last line to right lower colmn, line 13. | pp. 65, line 32 to pp. 66, line 17. |
| Surface active agent | pp. 201, left lower colmn, line 1 to pp. 210, right upper colmn, last line | pp. 18, right upper colmn, line 1 to pp. 24, right lower colmn, last line, and pp. 27, left lower colmn, line 10 from bottom to right lower colmn, line 9. | — |
| Fluorinated compound (anti-static agent, coating aid, lubricant and anti-adhesion agent) | pp. 210, left lower colmn, line 1 to pp. 222, left lower colmn, line 5. | pp. 25, left upper colmn, line 1 to pp. 27, right lower colmn, line 9. | — |
| Binder (hydrophilic colloid) | pp. 222, left lower colmn, line 6 to pp. 225, left upper colmn, last line | pp. 38, right upper colmn, lines 8 to 18. | pp. 66, lines 23 to 28. |
| Thickener | pp. 225, right upper colmn, line 1 to pp. 227, right upper colmn, line 2. | — | — |
| Anti-static agent | pp. 227, right upper colmn, line 3 to pp. 230, left upper colmn, line 1. | — | — |
| Polymer latex | pp. 230, left upper colmn, line 2 to pp. 239, last line | — | — |

-continued

| Photographic elements | JP-A-62-215292 | JP-A-2-33144 | EP 0,355,660A2 |
|---|---|---|---|
| Matting agent | pp. 240, left upper colmn, line 1 to right upper colmn, last line. | — | — |
| Photo-graphic process-ing method (processing steps and additives) | pp. 3, right upper colmn, line 7 to pp. 10, right upper colmn, line 5. | pp. 39, left upper colmn, line 4 to pp. 42, left upper colmn, last line. | pp. 67, line 14 to pp. 69, line 28. |

Remarks:
1. The content amended according to the Amendment of March 16, 1987 is included in the cited items of JP-A-62-215272.
2. Of the above color couplers, also preferably used as a yellow coupler are the so-called short wave type yellow couplers described in JP-A-63-231451, JP-A-63-123047, JP-A-63-241547, JP-A-1-173499, JP-A-1-213648, and JP-A-1-250944.

Also, as the color couplers described above, the so-called short wave-type yellow couplers described in JP-A-63-231451, JP-A-63-123047, JP-A-63-241547, JP-A-1-173499, JP-A-1-213648, and JP-A-1-250944 are preferably used.

It is preferred that each of the cyan, magenta, and yellow couplers is impregnated in a loadable latex polymer (e.g., U.S. Pat. No. 4,203,716) in the presence (or absence) of the high-boiling organic solvent described in the above table or is dissolved together with a polymer which is water-insoluble and organic solvent-soluble, and emulsion-dispersed in an aqueous hydrophilic colloid solution.

As the water-insoluble and organic solvent-soluble polymer being preferably used in the present invention, there are the homopolymers and the copolymers described in U.S. Pat. No. 4,857,449, columns 7 to 15 and PCT WO 88/00723, pages 12 to 30. Methacrylate series or acrylamide series polymer is more preferred and acrylamide polymer is most preferred.

For the photographic light-sensitive material of the present invention, it is preferred to use the color image storage stability improving compound as described in EP 0,277,589A2 together with the couplers. It is particularly preferred to use the foregoing compound together with a pyrazoloazole coupler or a pyrrolotriazole coupler.

That is, the use of the compound forming a chemically inactive and substantially colorless compound by chemically combining with an aromatic amine developing agent remaining after color developing processing described in the foregoing patent specification and/or the compound forming a chemically inactive and substantially colorless compound by chemically combining with the oxidation product of an aromatic amine developing agent remaining after color developing processing singly or simultaneously is preferred for preventing the formation of stains and the occurrence of other side actions by the formation of colored dyes by the reaction of couplers and the color developing agent or the oxidation product thereof remaining in the emulsion layers during storing the color images formed after processing.

Also, as the cyan coupler, the use of the diphenylimidazole type cyan couplers described in JP-A-2-33144 as well as the 3-hydroxypyridine type cyan couplers described in EP 0,333,185A2 (in particular, the two-equivalent coupler formed by bonding a chlorine releasing group to the four-equivalent coupler (42) illustrated therein, or the coupler (6) or (9) is preferred), the cyclic active methylene type cyan couplers described in JP-A-64-32260 (in particular, couplers 3, 8, and 34 illustrated therein as practical examples are particularly preferred), the pyrrolopyrazole type cyan couplers described in EP 0,456,226A1, the pyrroloimidazole type cyan couplers described in EP 0,484,909, and the pyrrolotriazole type cyan couplers described in EP 0,488,248 and EP 0,491,197A1 is preferred. In these cyan couplers, the use of the pyrrolotriazole type cyan couplers is particularly preferred.

As the yellow coupler, in addition to the compounds described in the above table, the acrylacetamide type yellow couplers having a 3 to 5 membered cyclic structure at the acyl group described in EP 0,447,969A1, the malondianilido type yellow couplers having a cyclic structure described in EP 0,482,552A1, and the acylacetamido type yellow couplers having a dioxane structure described in U.S. Pat. No. 5,118,599 are preferably used. In these couplers, the use of the acylacetamide type yellow couplers wherein the acyl group is a 1-alkylcyclopropane-1-carbonyl group and the malondianilido type yellow couplers wherein one of the anilides constitutes an indoline ring is particularly preferred. These couplers can be used singly or as a combination thereof.

As the magenta coupler being used in the present invention, the 5-pyrazolone series magenta couplers and the pyrazoloazole series magenta couplers as described in the known literature in the above table are used but in the points of the hue, the color image stability, coloring property, etc., the use of the pyrazolotriazole couplers wherein a secondary or tertiary alkyl group is directly bonded to the 2, 3, or 6-position of the pyrozolotriazole ring as described in JP-A-61-65245, the pyrazoloazole couplers having a sulfonamido group in the molecule as described in JP-A-61-65246, the pyrazoloazole couplers having an alkoxyphenylsulfonamido ballast group as described in JP-A-61-147254, and the pyrazoloazole couplers having an alkoxy group or an aryloxy group at the 6-position thereof as described in EP 0,226,849A and EP 0,294,785A is preferred.

For the processing process of the color photographic light-sensitive materials of the present invention, in addition to the processes described in the above table, the use of the processing materials and the processing processes described in JP-A-2-207250, page 26, right lower column, line 1 to page 34, right upper column, line 9 and JP-A-4-97355, page 5, left upper column, line 17 to page 18, right lower column, line 20 is preferred.

Then, the present invention is described more practically by the following examples.

SYNTHESIS EXAMPLE 1

Synthesis of 3-ethoxycarbonyl-5-hydroxypyrazole:

To 400 ml of ethanol were added 20.6 g (0.30 mole) of hydrazine hydrochloride and 63.0 g (0.33 mole) of sodium oxalacetate and after stirring the mixture for 2 hours at room temperature, the mixture was refluxed for 3 hours with stirring. After distilling off methanol, 100 ml of water was added to the residue followed by stirring for one hour at room temperature. Crystals formed were recovered by filtration and washed with water.

The amount of the product was 30.2 g (65% in yield). The melting point was from 180° to 182° C.

Synthesis of Compound A-1:

To 20 ml of methanol was added 15.6 g (0.10 mole) of 3-ethoxycarbonyl-5-hydroxypyrazole and after adding thereto 30 ml of 40% methanol solution of methylamine, the mixture was stirred in an autoclave for 9 hours at 100° C. After cooling the reaction mixture to room temperature, the reaction mixture was neutralized with concentrated hydrochoric acid and crystals formed were recovered by filtration. The amount of the product was 11.6 g (82% in yield). The melting point was 238° C. (decomp.)

SYNTHESIS EXAMPLE 2

Synthesis of 3-ethoxycarbonyl-5-hydroxy-1-methylpyrazole:

To 800 ml of ethanol were added 108 g (1.1 mole) of sulfuric acid, 92.1 g (2.0 moles) of methylhydrazine, and 462.4 g (2.2 moles) of sodium oxalacetate and after stirring the mixture for 2 hours at room temperature, the mixture was refluxed for 3 hours with stirring. After distilled off ethanol, 800 ml of water was added to the residue and the mixture was allowed to stand overnight at room temperature. Crystals formed were recovered by filtration and washed with water.

The amount of the product was 279 g (82% in yield). The melting point was 151° to 153° C.

Synthesis of Compound A-2:

A mixture of 8.5 g (0.05 mole) of 3-ethoxycarbonyl-5-hydroxy-1-methylpyrazole and 30 ml of 40% methanol solution of methylamine was stirred in an autoclave for 8 hours at 100° C. After cooling the reaction mixture to room temperature, the product was neutralized with concentrated hydrochloric acid and crystals formed were recovered by filtration. The amount of the product was 6.9 g (89% in yield). The melting point was 204° to 206° C.

SYNTHESIS EXAMPLE 3

Synthesis of Compound A-4:

A mixture of 46.8 g (0.30 mole) of 3-ethoxycarbonyl-5-hydroxypyrazole and 150 ml of pyrrolidine was refluxed for 18 hours with stirring. After cooling the reaction mixture to room temperature, 100 ml of water was added thereto and the product was neutralized to pH 5 with concentrated hydrochloric acid. Crystals formed were recovered by filtration and washed with an aqueous sodium chloride solution. The amount of the product was 46.2 (85% in yield). The melting point was 280° to 289° C.

SYNTHESIS EXAMPLE 4

Synthesis of Compound C-1:

To 15.6 g (0.10 mole) of 3-ethoxycarbonyl-5-hydroxypyrazole was added 35 ml (0.40 mole) of morpholine and the mixture was stirred in a nitrogen gas atmosphere for 12 hours at 130° C. while removing ethanol formed. After removing excessive morpholine under reduced pressure, 30 ml of a saturated aqueous sodium chloride solution was added to the reaction mixture and pH thereof adjusted to 4 with concentrated hydrochloric acid. Crystals formed were recovered by filtration and washed with a saturated aqueous sodium chloride solution. The amount of the product was 15.4 g (79% in yield). The melting point was 220° C. (decomp.).

SYNTHESIS EXAMPLE 5

Synthesis of Compound C-2:

To 117 ml (1.32 moles) of morpholine was added 56.7 g (0.33 mole) of 3-ethoxycarbonyl-5-hydroxy-1-methylpyrazole and the mixture was stirred in a nitrogen gas atmosphere for 18 hours at 130° C. while removing ethanol formed. After distilling off excessive morpholine under reduced pressure, 100 ml of a saturated aqueous sodium chloride solution was added thereto and pH was adjusted to 4 with concentrated hydrochloric acid. Crystals formed were recovered by filtration and washed with a saturated aqueous sodium chloride solution. The amount of the product was 58.1 g (82% in yield). The melting point was 172° to 174° C.

Compound A-3, Compound A-5, Compound C-3, and Compound C-4 can be synthesized by the same manners as above.

SYNTHESIS EXAMPLE 6

Synthesis of Compound 106:

After mixing 3.4 g (24 mmoles) of Compound A-2 and 3.0 g (11.4 mmoles) of malonaldehydedianyl with 30 ml of dimethylformamide (DMF), 5 ml of triethylamine was further added to the mixture and the mixture was stirred for 4 hours at 50° C. After cooling the reaction mixture to room temperature, 4.7 g of potassium acetate was added thereto and crystals formed were recovered by filtration and washed with isopropanol. The amount of the product was 3.4 g (80% in yield). $\lambda_{max}$ 534 nm ($H_2O$).

SYNTHESIS EXAMPLE 7

Synthesis of Compound 108:

After mixing 5.44 g (30 mmoles) of Compound A-4 and 3.33 g (15 mmoles) of malonaldehydedianyl with 27 ml of acetonitrile, 5 ml of triethylamine was further added to the mixture and the mixture was stirred for 4 hours at 60° C. After cooling the reaction mixture to room temperature, 25 ml of 15% methanol solution of potassium acetate and 20 ml of isobutanol was further added thereto. Crystals precipitated were recovered by filtration and washed with isobutanol. The amount of the product was 4.1 g (63% in yield). $\lambda_{max}$ 531 nm ($H_2O$).

SYNTHESIS eXAMPLE 8

Synthesis of Compound 111:

After mixing 3.94 g (20 mmoles) of Compound C-1 and 1.48 g (10 mmoles) of ethyl orthoformate with 16 ml of methanol, 2 ml of triethylamine and 1 ml of acetic acid were further added thereto and the mixture was refluxed for 6 hours. After cooling the reaction mixture to room temperature, 2.0 g of potassium acetate was added and further 20 ml of isobutanol was added thereto. Crystals precipitated were recovered by filtration and washed with isobutanol. The amount of the product was 2.11 g (48% in yield). $\lambda_{max}$ 450 nm ($H_2O$).

SYNTHESIS EXAMPLE 9

Synthesis of Compound 112:

After mixing 4.22 g (20 mmoles) of Compound C-2 and 1.48 g (10 mmoles) of ethyl orthoformate with 16 ml of methanol, 2 ml of triethylamine and 1 ml of acetic acid were added thereto and the mixture was refluxed for 6 hours. After cooling the reaction mixture to room temperature, 2.0 g of potassium acetate was added and further 20 ml of isobutanol was added thereto. Crystals precipitated were recovered by filtration and washed with isobutanol. The amount of the product was 2.74 g (55% in yield). $\lambda_{max}$ 453 nm ($H_2O$).

SYNTHESIS EXAMPLE 10

Synthesis of Compound 3:

After mixing 3.94 g (20 mmoles) of Compound C-1 and 1.98 g (13 mmoles) of 1,3,3-trimethoxy-1-propene with 16 ml of methanol, 2 ml of triethylamine and 1 ml of acetic acid were further added thereto and the mixture was refluxed for 6 hours. After cooling the reaction mixture to room temperature, 2.0 g of potassium acetate was added and 20 ml of isobutanol was further added thereto. Crystals precipitated were recovered by filtration and washed with isobutanol. The amount of the product was 2.64 g (56% in yield). $\lambda_{max}$ 532 nm ($H_2O$).

SYNTHESIS EXAMPLE 11

Synthesis of Compound 118:

After mixing 4.22 g (20 mmoles) of Compound C-2 and 2.22 g (10 mmoles) of malonaldehydodianyl with 10 ml of DMF, 2 ml of triethylamine was further added thereto and the mixture was stirred for 3 hours at 60° C. After cooling the reaction mixture to room temperature, 2.0 g of potassium acetate was added and 20 ml of isobutanol was further added thereto. Crystals precipitated were recovered by filtration and washed with isobutanol. The amount of the product was 3.64 g (73% in yield). $\lambda_{max}$ 532 nm ($H_2O$).

SYNTHESIS EXAMPLE 12

Synthesis of Compound 6:

After mixing 4.82 g (20 mmoles) of Compound C-4 and 2.22 g (10 mmoles) of malonaldehydodianyl with 10 ml of DMF, 2 ml of triethylamine was further added thereto and the mixture was stirred for 3 hours at 60° C. After cooling the reaction mixture to room temperature, 2.0 g of potassium acetate was added and 20 ml of isobutanol was further added thereto. Crystals precipitated were recovered by filtration and washed with isobutanol. The amount of the product was 3.52 g (63% in yield). $\lambda_{max}$ 531 nm ($H_2O$).

SYNTHESIS EXAMPLE 13

Synthesis of Compound 115:

After mixing 3.94 g (20 mmoles) of Compound C-1 and 2.85 g (10 m moles) of glutaconaldehydodianyl hydrochloride with 10 ml of methanol, 3.4 ml (24 mmoles) of triethylamine was added thereto and the mixture was stirred for 5 hours at 50° C. After cooling the reaction mixture to room temperature, 2.0 g of potassium acetate and 10 ml of methanol were added thereto. Inorganic salts precipitated were filtered off. The filtrate obtained was concentrated, 20 ml of isobutanol was added thereto, and crystals precipitated were recovered by filtration and washed with isobutanol. The amount of the product was 2.81 g (57% in yield). $\lambda_{max}$ 624 nm ($H_2O$).

SYNTHESIS EXAMPLE 14

Synthesis of Compound 116:

After mixing 4.22 g (20 mmoles) of Compound C-2 and 2.22 g (10 mmoles) of glutaconaldehydrodianyl with 10 ml of methanol, 3.4 ml (24 mmoles) of triethylamine was added thereto and the mixture was stirred for 5 hours at 50° C. After cooling the reaction mixture to room temperature, 2.0 g of potassium acetate and 10 ml of methanol were added thereto and inorganic salts precipitated were filtered off. The filtrate was concentrated, 20 ml of isobutanol was added to the residue, and crystals precipitated were recovered by filtration and washed with isobutanol. The amount of the product was 1.72 g (33% in yield). $\lambda_{max}$ 626 nm ($H_2O$).

EXAMPLE 1

An aqueous 1% dye solution was added to an aqueous 10% gelatin solution and the mixture was adjusted such that when the mixture was coated at 80 g/m$^2$, the optical density became 1.0. To the mixture was added a hardening agent in an amount of 2.6% to gelatin. The liquid thus prepared was coated on a polyester film base having a subbing layer and after drying for 24 hours at 50° C., the coated film was cut into a rectangle of 10 cm×12 cm to provide a sample piece.

The sample was washed with running water for 60 seconds at 25° C. and dried. The densities of 5 points of each sample were obtained before and after processing using a Macbeth transmittance densitometer TD-504 and the average value thereof was defined as the density. The results are shown in Table 1.

As is clear from the results shown in Table 1 below, the dyes of this invention show the excellent decoloring property.

TABLE 1

| Dye | Before Processing | After Processing |
|---|---|---|
| 9 | 1.00 | 0.05 |
| 109 | 1.00 | 0.06 |
| 112 | 0.99 | 0.02 |
| 3 | 1.00 | 0.02 |
| 11 | 1.00 | 0.03 |
| 6 | 1.02 | 0.04 |
| 116 | 1.01 | 0.02 |
| Comparative dye 1 | 0.98 | 0.14 |
| Comparative dye 2 | 0.99 | 0.18 |
| Comparative dye 3 | 1.01 | 0.92 |
| Comparative dye 4 | 1.00 | 0.11 |
| No addition | 0.02 | 0.02 |

Comparative Dye 1

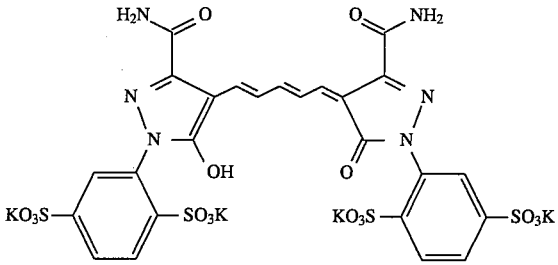

Comparative Dye 2

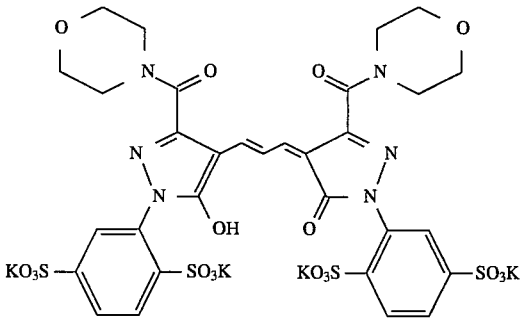

TABLE 1-continued

Comparative Dye 3

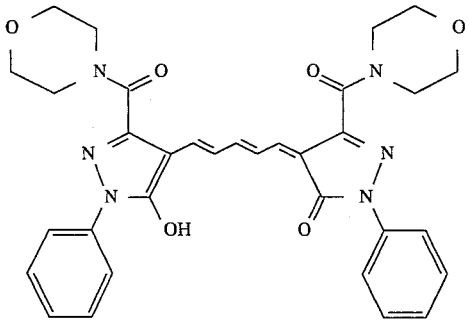

zinc stearate was added thereto at a ratio of 3.0% by weight to the amount of titanium dioxide. After kneading the polyethylene together with ultramarine blue (DV-1, trade name, made by Daiichi Kasei Kogyo K.K.) in a banbury mixer, the mixture was formed to pellets to provide a masterbatch. The size of titanium dioxide measured by an electronmicroscope was from 0.15 μm to 0.35 μm and aluminum oxide hydrate was coated on titanium dioxide in an amount of 0.75% by weight to titanium dioxide as $Al_2O_3$.

After applying a corona discharging treatment of 10 kVA onto a paper substrate having a basis weight of 170 g/m$^2$ the masterbatch was melt extruded onto the paper substrate at 320° C. using a multilayer extruding coating die to form polyethylene laminate layers at the layer thicknesses shown in Table 2. A glow discharging treatment was applied to the surface of the polyethylene layer.

TABLE 2

| | Construction of Waterproof Resin Layer of Suppor | | | | | | |
|---|---|---|---|---|---|---|---|
| | Uppermost Layer | | Interlayer | | Undermost Layer | | Total $TiO_2$ |
| Support | $TiO_2$ Content (wt %) | Thickness (μ) | $TiO_2$ Content (wt %) | Thickness (μ) | $TiO_2$ Content (wt %) | Thickness (μ) | used Amount (g/m$^2$) |
| A | 6 | 30μ | — | — | — | — | 1.75 |
| B | 10 | 30 | — | — | — | — | 3.0 |
| C | 15 | 30 | — | — | — | — | 4.7 |
| D | 35 | 30 | — | — | — | — | 13.3 |
| E | 10 | 15 | — | — | 0 | 15 | 1.5 |
| F | 15 | 15 | — | — | 0 | 15 | 2.4 |
| G | 30 | 15 | — | — | 15 | 15 | 7.8 |
| H | 35 | 15 | — | — | 0 | 15 | 6.7 |
| I | 0 | 0.5 | 15 | 29 | 10 | 0.5 | 4.6 |
| J | 10 | 2.0 | 35 | 15 | 0 | 13 | 6.9 |

TABLE 1-continued

Comparative Dye 4

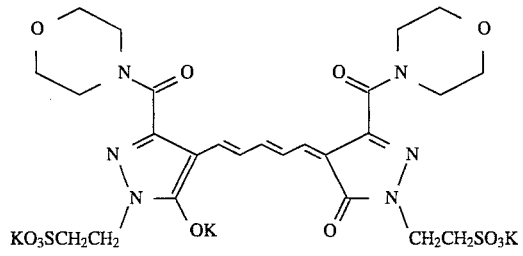

Hardner

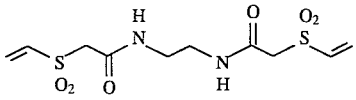

EXAMPLE 2

(Preparation of Support)

To low-density polyethylene (MRF=3) was added titanium dioxide at the ratio shown in Table 2 below and also (Preparation of Light-Sensitive Material 100)

A multilayer color photographic printing paper (100) having the layer structure show below was prepared by coating various layers on the reflective support (A) described above. Each coating liquid was prepared as follows.

Preparation of Coating Liquid for Layer 1:

In a mixed solvent of 25 g of a solvent (Solv-1), 25 g of a solvent (Solv-2), and 180 ml of ethyl acetate were dissolved 153.0 g of a yellow coupler (ExY), 15.0 g of a color image stabilizer (Cpd-1), 7.5 g of a color image stabilizer (Cpd-2), and 16.0 g of a color image stabilizer (Cpd-3) and the solution was dispersed by emulsification in 1,000 g of an aqueous 10% gelatin solution containing 60 ml of 10% sodium dodecylbenzenesulfonate and 10 g of citric acid to provide an emulsified dispersion A.

On the other hand, a silver chlorobromide emulsion A-1 (cubic, a 3:7 mixture (by mole ratio of silver) of a large size emulsion having a mean grain size of 0.88 μm and a small size emulsion having a mean grain size of 0.70 μm, the variation coefficients of the grain size distributions of them were 0.08 and 0.10, respectively, in each emulsion, 0.3 mole % silver bromide was localized at a part of the surfaces of the silver chloride grains, and the inside of the silver chloride grain and the foregoing local phase of the silver halide grain contained potassium hexachloroiridate (IV) in a total amount of 0.1 mg and potassium ferrocyanide in a total amount of 1.0 mg) was prepared. In the silver chlorobromide, after adding the blue-sensitive sensitizing dyes A and B shown below to the large size emulsion and the small size emulsion in the amounts of $2.0\times10^{-4}$ mole and $2.5\times10^{-4}$ mole, respectively per mole of silver, a sulfur sensitizer and a gold sensitizer were added to the silver chlorobromide emulsion in the existence of the decomposition product of nucleic acid and then the silver chlorobromide emulsion was most suitably chemically sensitized.

The emulsified dispersion A described above was mixed with the silver chlorobromide emulsion A-1 and the coating liquid for Layer 1 having the composition shown below was prepared.

The coating liquids for Layer 2 to layer 7 were also prepared by the same manner as in preparing the coating liquid for Layer 1.

As a gelatin hardening agent for each layer, 1-oxy-3,5-dichloro-s-triazine sodium salt was used.

Also, Cpd-14 and Cpd-15 were added to each layer in the amounts of 25.0 mg/m$^2$ and 50.0 mg/m$^2$, respectively.

Furthermore, the size of the silver chlorobromide grains of each silver chlorobromide emulsion for following light-sensitive emulsion layers was adjusted by the same manner as the case of the silver chlorobromide emulsion A-1 and the following spectral sensitizing dyes were used for each emulsion layer.

Blue-Sensitive Emulsion Layer:

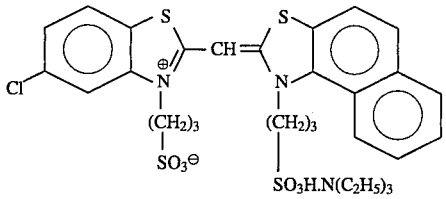

Sensitizing dye A and

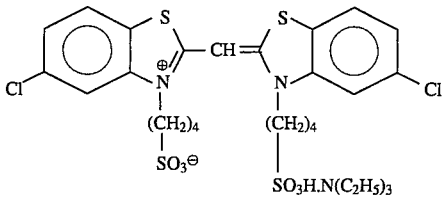

Sensitizing dye B ($2.0\times10^{-4}$ mole each to the large size emulsion and $2.5\times10^{-4}$ mole each to the small size emulsion per mole of silver halide)

Green-Sensitive Emulsion Layer:

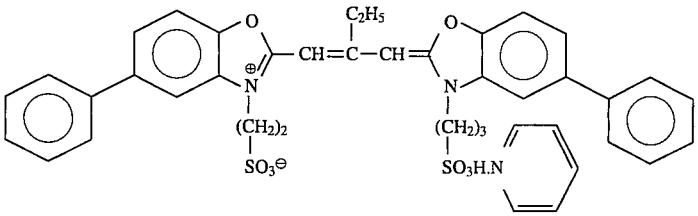

Sensitizing dye C ($4.0\times10^{-4}$ mole to the large size emulsion and $5.6\times10^{-4}$ mole to the small size emulsion per mole of silver halide) and Sensitizing dye D

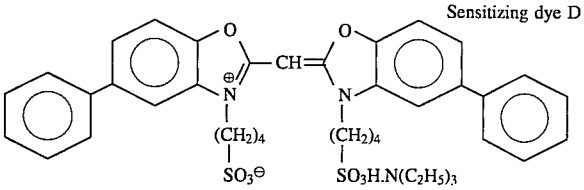

($7.0\times10^{-5}$ mole to the large size emulsion and $1.0\times10^{-4}$ mole to the small size emulsion per mole of silver halide)

Red-Sensitive Emulsion Layer:

Sensitizing dye E

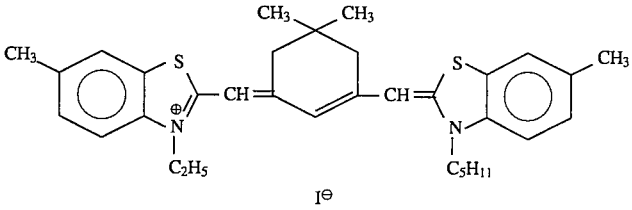

($0.9\times10^{-4}$ mole to the large size emulsion and $1.1\times10^{-4}$ mole to the small size emulsion per mole of silver halide)

Furthermore, to the red-sensitive emulsion layer was added the following compound in an amount of $2.6\times10^{-3}$ mole per mole of silver halide.

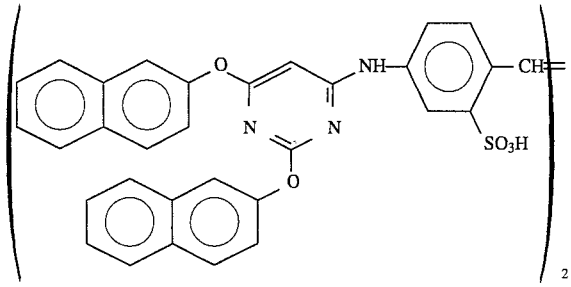

Also, 1-(5-methylureidophenyl)-5-mercaptotetrazole was added to the blue-sensitive emulsion layer, the green-sensitive emulsion layer, and the red-sensitive emulsion layer in the amounts of $8.5\times10^{-4}$ mole, $3.0\times10^{-3}$ mole, and $2.5\times10^{-4}$ mol respectively, per mole of silver halide.

Furthermore,4-hydroxy-6-methyl-1,3,3a,7-tetraazindene was added to the blue-sensitive emulsion layer and the green-sensitive emulsion layer in the amounts of $1\times10^{-4}$ mole and $2\times10^{-4}$ mole, respectively, per mole of silver halide.

(Layer Structure)

The composition of each layer is shown below. The numeral shows the coated amount ($g/m^2$). The case of the silver halide emulsion is shown by the silver-converted coated amount.

Support (A):

The resin layer at the Layer 1 side contained a bluish dye (ultramarine blue).

| | |
|---|---|
| Layer 1 (Blue-sensitive emulsion layer): | |
| Silver chlorobromide emulsion A-1 | 0.27 |
| Gelatin | 1.22 |
| Yellow coupler (ExY) | 0.79 |
| Color image stabilizer (Cpd-1) | 0.08 |
| Color image stabilizer (Cpd-2) | 0.04 |
| Color image stabilizer (Cpd-3) | 0.08 |
| Solvent (Solv-1) | 0.13 |
| Solvent (Solv-2) | 0.13 |
| Layer 2 (Color mixing inhibition layer): | |
| Gelatin | 0.90 |
| Color mixing inhibitor (Cpd-4) | 0.06 |
| Solvent (Solv-2) | 0.25 |
| Solvent (Solv-3) | 0.25 |
| Solvent (Solv-7) | 0.03 |
| Layer 3 (Green-sensitive emulsion layer): | |
| Silver chlorobromide emulsion B-1 | 0.13 |

(cubic, a 1:3 mixture (by mole ratio of silver) of a large size emulsion having a mean grain size of 0.55 μm and a small size emulsion having a mean grain size of 0.39 μm, the variation coefficients of the grain size distributions thereof were 0.08 and 0.06, respectively, 0.8 mole % silver bromide was localized at a part of the surfaces of the silver chloride grains, and the inside of the grains and the local phases of the silver bromide contained potassium hexachloroiridate (IV) in the total amounts of 0.1 mg and potassium ferrocyanide in the total amounts of 1 mg)

| | |
|---|---|
| Gelatin | 1.45 |
| Magenta coupler (ExM) | 0.16 |
| Color image stabilizer (Cpd-2) | 0.03 |
| Color image stabilizer (Cpd-5) | 0.15 |
| Color image stabilizer (Cpd-6) | 0.01 |
| Color image stabilizer (Cpd-7) | 0.01 |
| Color image stabilizer (Cpd-8) | 0.08 |
| Solvent (Solv-3) | 0.50 |
| Solvent (Solv-4) | 0.15 |
| Solvent (Solv-5) | 0.15 |
| Layer 4 (Color mixing inhibition layer): | |
| Gelatin | 0.70 |
| Color mixing inhibitor (Cpd-4) | 0.04 |
| Solvent (Solv-2) | 0.18 |
| Solvent (Solv-3) | 0.18 |
| Solvent (Solv-7) | 0.02 |
| Layer 5 (Red-sensitive emulsion layer): | |
| Silver chlorobromide emulsion C-1 | 0.18 |

(cubic, a 1:4 mixture (by mole ratio of silver) of a large size emulsion having a mean grain size of 0.50 μm and small size emulsion having a mean grain size of 0.41 μm, the variation coefficients of the grain size distributions thereof were 0.09 and 0.11, respectively, 0.8 mole % silver bromide was localized at a part of the surfaces of the silver chloride grains, and the insides of the grains and the local phases of silver bromide contained potassium hexachloroiridate (IV) in the total amounts of 0.3 mg and potassium ferrocyanide in the total amounts of 1.5 mg.)

| | |
|---|---|
| Gelatin | 0.80 |
| Cyan coupler (ExC) | 0.33 |
| Ultraviolet absorbent (UV-2) | 0.18 |
| Color image stabilizer (Cpd-1) | 0.33 |
| Color image stabilizer (Cpd-2) | 0.03 |
| Color image stabilizer (Cpd-6) | 0.01 |
| Color image stabilizer (Cpd-8) | 0.01 |
| Color image stabilizer (Cpd-9) | 0.01 |
| Color image stabilizer (Cpd-10) | 0.01 |
| Color image stabilizer (Cpd-11) | 0.01 |
| Solvent (Solv-1) | 0.01 |
| Solvent (Solv-6) | 0.22 |
| Layer 6 (Ultraviolet absorption layer): | |
| Gelatin | 0.48 |
| Ultraviolet absorbent (UV-1) | 0.38 |
| Color image stabilizer (Cpd-5) | 0.02 |
| Color image stabilizer (Cpd-12) | 0.15 |
| Layer 7 (Protective layer) | |
| Gelatin | 1.10 |
| Acryl-modified copolymer of polyvinyl alcohol (modified degree 17%) | 0.05 |
| Liquid paraffin | 0.02 |
| Color image stabilizer (Cpd-13) | 0.01 |

Then, the compounds used for preparing the color photographic printing paper described above are shown below.

(ExY) Yellow coupler
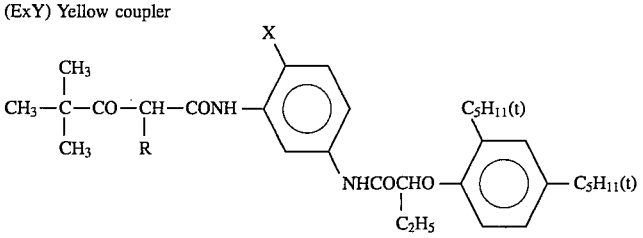
1) 2)
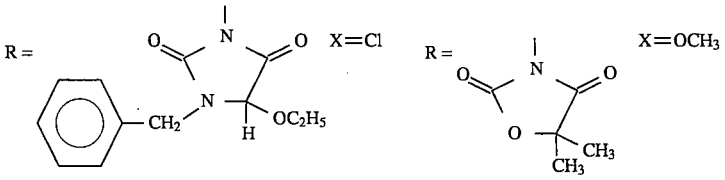
1:1 mixture (molar ratio) of 1) and 2)
(ExM) Magenta coupler
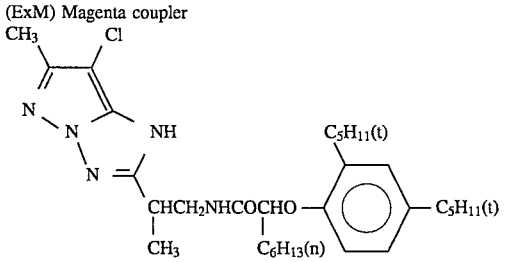
(ExC) Cyan coupler
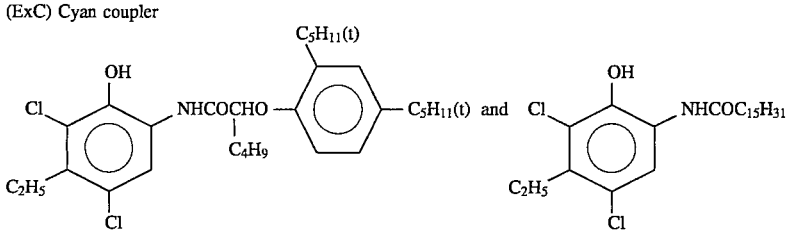
3:7 mixture (molar ratio)
(Cpd-1) Dye image stabilizer
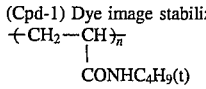
average molecular weight: 60,000
(Cpd-2) Dye image stabilizer
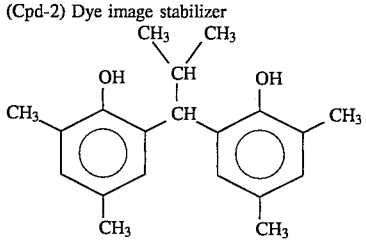
(Cpd-3) Dye image stabilizer
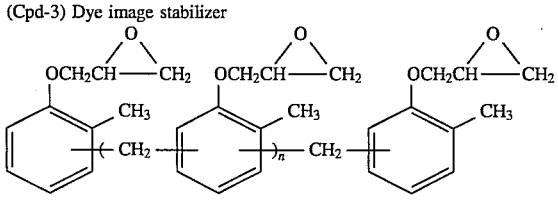
n = 7–8 (average value)
(Cpd-4) Color mixing preventing agent -continued
(1)
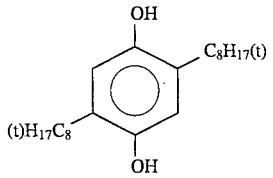
(2)
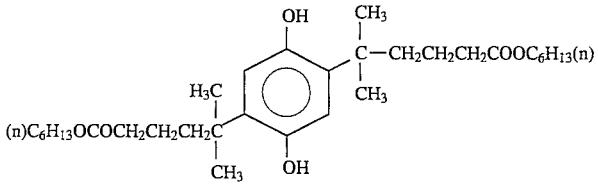
1:1 mixture of (weight ratio of (1) and (2))
(Cpd-5) Dye image stabilizer
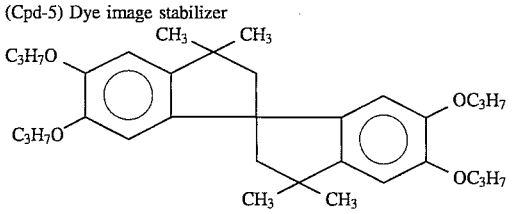
(Cpd-6) Dye image stabilizer
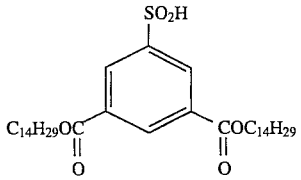
(Cpd-7) Dye image stabilizer
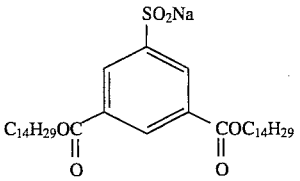
(Cpd-8) Dye image stabilizer
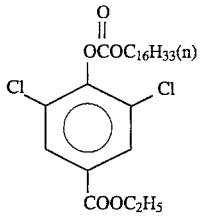
(Cpd-9) Dye image stabilizer
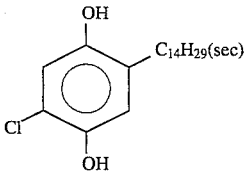
(Cpd-10) Additive
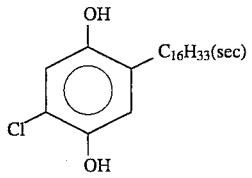
(Cpd-11) Additive
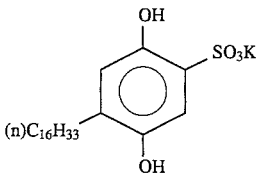
(Cpd-12) Dye image stabilizer
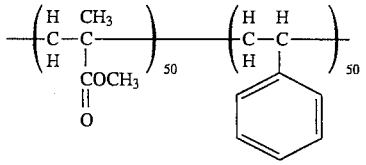
Average molecular weight: about 60,000
(Cpd-13) Dye image stabilizer
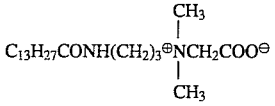

-continued
(Cpd-14) Preservative
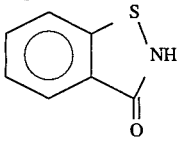
(Cpd-15) Preservative
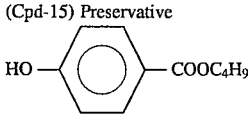
(IV-1) UV Absorber
(1)
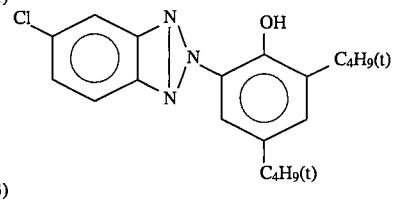
(2)
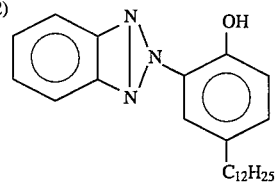
(3)
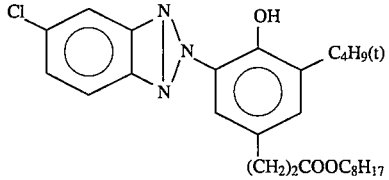
(4)
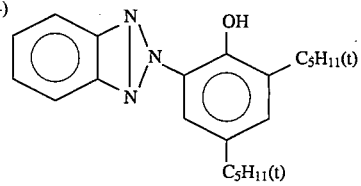
1:5:10:5 mixture (weight ratio) of (1), (2), (3) and (4)
(UV-2) UV Absorber
(1)
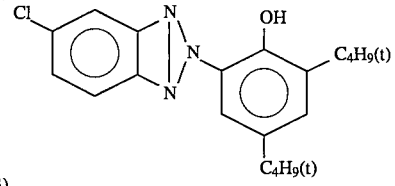
(2)
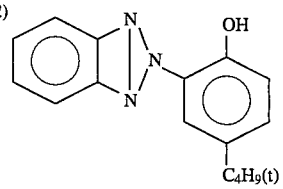
(3)
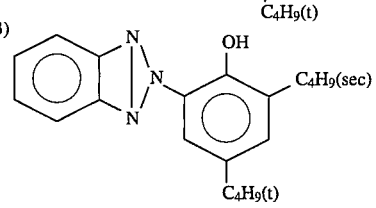
1:2:2 mixture (weight ratio) of (1), (2) and (3)
(Solv-1) Solvent
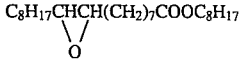
(Solv-2) Solvent
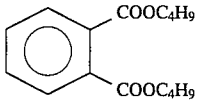
(Solv-3) Solvent
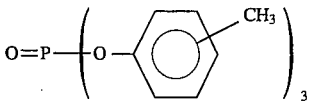
(Sov-4) Solvent
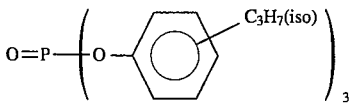

(Solv-5) Solvent $O{=}P{+}OCH_2\overset{C_2H_5}{\overset{|}{C}}HC_4H_9(n))_3$

-continued (Solv-6) Solvent

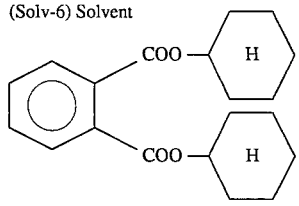

(Solv-7) Solvent

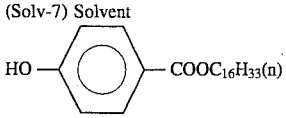

By following the same procedure as the case of preparing the sample 100 except that the support and the addition compound were changed as shown in Table 3 below, samples 101 to 169 were prepared. Each addition compound was added to Layer 2 (color mixing inhibition layer) and Layer 4 (color mixing inhibition layer) such that the total coated amounts became $4\times10^{-5}$ mol/m$^2$. In addition, it was confirmed by the cross-sectional photograph that the added compound did not remain in the added layer but was diffused almost uniformly in all the layers during coating the layer.

TABLE 3

| | Used Compound ($4 \times 10^{-5}$ mole/m$^2$) | | | | | | |
|---|---|---|---|---|---|---|---|
| Support | — | Comp. A | Comp. B | (11) | (15) | (19) | (89) |
| A | 100 | 110 | 120 | 130 | 140 | 150 | 160 |
| B | 101 | 111 | 121 | 131* | 141* | 151* | 161* |
| C | 102 | 112 | 122 | 132* | 142* | 152* | 162* |

TABLE 3-continued

| | Used Compound ($4 \times 10^{-5}$ mole/m$^2$) | | | | | | |
|---|---|---|---|---|---|---|---|
| Support | — | Comp. A | Comp. B | (11) | (15) | (19) | (89) |
| D | 103 | 113 | 123 | 133* | 143* | 153* | 163* |
| E | 104 | 114 | 124 | 134 | 144 | 154 | 164 |
| F | 105 | 115 | 125 | 135* | 145* | 155* | 165* |
| G | 106 | 116 | 126 | 136* | 146* | 156* | 166* |
| H | 107 | 117 | 127 | 137* | 147* | 157* | 167* |
| I | 108 | 118 | 128 | 138* | 148* | 158* | 168* |
| J | 109 | 119 | 129 | 139* | 149* | 159* | 169* |

In the above table, compounds A and B are comparison compounds shown below, the compounds (11), (15), (19), and (89) are the compounds of this invention, and in sample Nos. 100 to 169, the mark * means the sample of this invention.

Comparison Compound A:

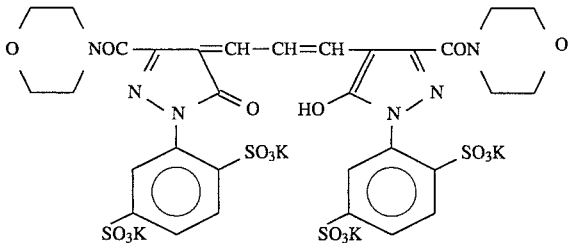

Sum of the atomic weights
$R_1 + R_3 = 428$

Comparison Compound B

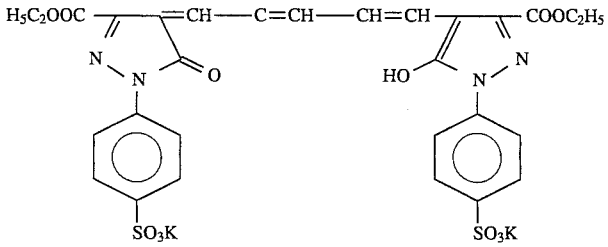

Sum of the atomic weights
$R_1 + R_3 = 268$

Using each of the samples thus prepared (after finishing the layer hardening reaction), the evaluation of the following scratch test was performed for determining the extent of pressure fog.

(Scratch Test Method)

An acrylic plate applied with a nylon scrubbing brush piece (1 cm×3 cm) was fixed by applying thereto a load of 200 g. Each sample cut into a size of 3 cm×15 cm was inserted in the acrylic plate (such that the light-sensitive layer coated surface was brought into contact with the nylon scrubbing brush), and the sample was pulled to the vertical direction to the load at a definite speed in the dark to give scratch to the surface of the light-sensitive layer with the nylon scrubbing brush. The scratch test was carried out in the dark room kept at 25° C. and 55% R.H.

The sample thus scratched was processed using the processing steps shown below. About the sample thus obtained, the extent of the yellow fog formed by the scratch was visually evaluated.

The grades of the evaluation were as follows.

o: Almost no scratch fog was observed.

Δ: Scratch fog was slightly observed.

x: Scratch fog was observed.

xx: Scratch fog was observed on the whole surface and the sample was unsuitable for practical use.

The results Obtained are shown in Table 4 below.

TABLE 4

| | Addition Compound | | | | | | |
|---|---|---|---|---|---|---|---|
| Support | — | Compound A | Compound B | (11) | (15) | (19) | (89) |
| A | Sample 100<br>O 6.8 | Sample 110<br>O | Sample 120<br>O | Sample 130<br>O | Sample 140<br>O | Sample 150<br>O | Sample 160<br>O |
| B | Sample 101<br>Δ 11.5 | Sample 111<br>Δ | Sample 121<br>Δ | Sample 131<br>O | Sample 141<br>O | Sample 151<br>O | Sample 161<br>O |
| C | Sample 102<br>X 13.2 | Sample 112<br>X | Sample 122<br>X | Sample 132<br>O | Sample 142<br>O | Sample 152<br>O | Sample 162<br>O |
| D | Sample 103<br>XX 21.6 | Sample 113<br>XX | Sample 123<br>XX | Sample 133<br>Δ | Sample 143<br>Δ | Sample 153<br>Δ | Sample 163<br>Δ |
| E | Sample 104<br>O 8.5 | Sample 114<br>O | Sample 124<br>O | Sample 134<br>O | Sample 144<br>O | Sample 154<br>O | Sample 164<br>O |
| F | Sample 105<br>Δ 13.1 | Sample 115<br>Δ | Sample 125<br>Δ | Sample 135<br>O | Sample 145<br>O | Sample 155<br>O | Sample 165<br>O |
| G | Sample 106<br>XX 20.2 | Sample 116<br>XX | Sample 126<br>X | Sample 136<br>O-Δ | Sample 146<br>O-Δ | Sample 156<br>O-Δ | Sample 166<br>O-Δ |
| H | Sample 107<br>X 21.5 | Sample 117<br>X | Sample 127<br>X | Sample 137<br>O | Sample 147<br>O | Sample 157<br>O | Sample 167<br>O |
| I | Sample 108<br>X 13.0 | Sample 118<br>X | Sample 128<br>X | Sample 138<br>O | Sample 148<br>O | Sample 158<br>O | Sample 168<br>O |
| J | Sample 109<br>XX 21.0 | Sample 119<br>X | Sample 129<br>X | Sample 139<br>O | Sample 149<br>O | Sample 159<br>O | Sample 169<br>O |

The characters of the evaluations were same as the scratch test method described before.

In the above Table 4, the left side shows the scratch evaluation of samples 100 to 169 and the right side shows the sharpness evaluation C(lines/mm) of samples 100 to 109.

Then, for the purpose of evaluating the effect of the support for the sharpness of the photographic light-sensitive material, by contact exposing each of the samples 100 to 109 to an optical wedge having rectangular patterns of various frequencies using light of the light source of an actinometer (manufactured by Fuji Photo Film Co., Ltd.) through a vapor deposited interference filter 470 nm, the resolving power of yellow color was determined.

As the character of the resolving power, the frequency C (lines/mm) when a CTF value (the ratio of the density difference $\Delta D_0$ between the high density portion and the low density portion in the case that the frequency was 0, that is, there was no repeat of the rectangular pattern, and a continuous light exposure was performed in a very wide area of the high light intensity portion and the low light intensity portion and the density difference $\Delta D_c$ between the high density portion and the low density portion in the frequency C (lines/mm) of the rectangular pattern: i.e., $\Delta D_c/\Delta D_0$) became 0.5 was determined. The results obtained are shown in Table 4 above. The larger value of C means that the resolving power is higher. If the value of C is about 10 or more, the light-sensitive material is said to have a high resolving power.

| Processing step | Temperature (°C.) | Time (sec.) | Replenisher* (ml) | Tank volume (liter) |
|---|---|---|---|---|
| Color development | 35 | 45 | 161 | 10 |
| Blix | 30–35 | 45 | 215 | 10 |
| Rinse (1) | 30–35 | 20 | — | 5 |
| Rinse (2) | 30–35 | 20 | — | 5 |
| Rinse (3) | 30–35 | 20 | 350 | 5 |
| Drying | 70–80 | 60 | | |

*: The replenishing amount was per 1 $m^2$ of each sample.

[Rinse was carried out by a 3 tank counter current system of (1) to (3).]

The composition of each processing liquid was as follows.

| Color Developer | Tank | Replenisher liquid |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25.0 g |
| N-Ethyl-N-(β-methanesulfonamido-ethyl)-3-methyl-4-aminoaniline sulfate | 5.0 g | 7.0 g |

-continued

| | | |
|---|---|---|
| N,N-Bis(carboxymethyl)hydrazine | 4.0 g | 5.0 g |
| N,N-Di(sulfoethyl)hydroxylamine.1Na | 4.0 g | 5.0 g |
| Fluorescent brightening agent (WHITEX 4B, trade name, made by Sumitomo Chemical Company, Ltd.) | 1.0 g | 2.0 g |
| Water to make | 1000 ml | 1000 ml |
| pH (25° C.) | 10.05 | 10.45 |

| Blix Liquid (Tank liquid = replenisher) | |
|---|---|
| Water | 400 ml |
| Ammonium thiosulfate (700 g/liter) | 100 ml |
| Sodium sulfite | 17 g |
| Ethylenediaminetetraacetic acid iron(III) ammonium | 55 g |
| Disodium ethylenediaminetetraacetate | 5 g |
| Ammonium bromide | 40 g |
| Water to make | 1000 ml |
| pH (25° C.) | 6.0 |
| Rinse liquid (Tank liquid = replenisher) | |
| Ion exchanged water (content of each of Ca and Mg was less than 3 ppm). | |

From the results obtained, the following matters were confirmed.

In the samples 100, 110, and 120 and the samples 104, 114, and 124 using the support A and the support B each having the waterproof resin coated layers having a content of titanium oxide of less than 2.0 g/m$^2$, the problem of the scratch fog does not occur without using the compound of the present invention but the sharpness is low. By using the support having the waterproof resin coated layers having a titanium oxide content of 2.0 g/m$^2$ or more and without using the compound of the present invention, the sharpness can be improved but the formation of the scratch fog is increased (samples 102, 112, 122, etc.). It can be seen that the extent of the scratch fog is increased with the increase of the amount titanium oxide used (samples 103, 113, 123, etc.). On the other hand, it can be seen that by using the compound of the present invention, the photographic light-sensitive material which causes less scratch fog and is excellent in sharpness can be obtained (samples 131, 141, 151, 161, etc.).

EXAMPLE 3

(Preparation of Support)

A mixed composition of a polyester having 6.5 of limited viscosity, synthesized by the condensation polymerization of a dicarboxylic acid composition and ethylene glycol, and titanium oxide (A-10, trade name, made by Titan Kogyo K.K.) as shown in Table 5 below was melt-mixed by a biaxial mixing extruding machine at 300° C. and melt-extruded onto the surface of a base paper of 180 μm in thickness from a T die to form a laminate layer having a thickness of 30 μm. Then, a resin composition containing calcium carbonate was melt-extrude onto the opposite surface of the base paper at 300° C. to form a laminate layer having a thickness of 30 μm. After applying a corona discharging treatment onto the resin surface of the reflective support having the laminated layers at the side of being coated with silver halide emulsion layers, the subbing coating liquid having the composition shown below was coated thereon at 5 ml/m$^2$ and dried for 2 minutes at 80° C. to provide photographic supports K to R.

| (Subbing Composition) | |
|---|---|
| Compound (EXU1) | 0.2 g |
| Compound (EXU2) | 0.001 g |
| Water | 35 ml |
| Methanol | 65 ml |
| Gelatin | 2 g |
| pH | 9.5 |

TABLE 5

| Support | Coated resin (molar ratio of dicarboxylic acid composition of polyester) | $TiO_2$(g/m$^2$) |
|---|---|---|
| K | Polyester (Terephthalic acid 100) | 1.8 |
| L | " | 2.5 |
| M | " | 4.5 |
| N | " | 9.5 |
| O | " | 15.0 |
| P | " | 22.0 |
| Q | Polyester (Terephthalic acid/isophthalic acid 80/20) | 1.8 |
| R | Polyester (Terephthalic acid/isophthalic acid 80/20) | 9.5 |

EXU1

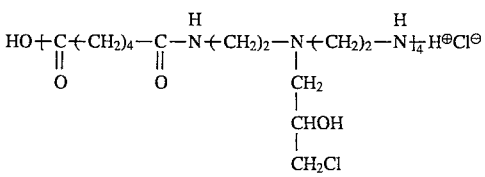

EXU2

$C_{12}H_{25}O(CH_2CH_2O)_{10}H$

Comparison Compound C

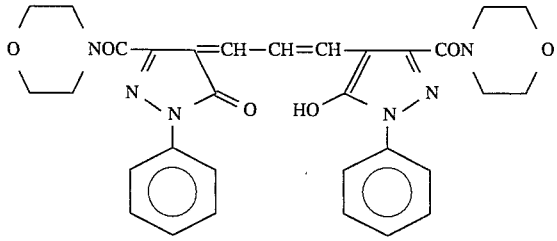

Sum of the atomic weights
$R_1 + R_3 = 191$ (Preparation and Evaluation of Light-Sensitive Material)

A light-sensitive material 200 was prepared by forming the layers same as these of the light-sensitive material 100 in Example 2 on the reflective support K described above.

Also, by following the same procedure as the sample 200 except that the support and the addition compound were changed as shown in Table 6, samples 201 to 263 were prepared. The addition compound was added to Layer 2 and Layer 4 (color mixing inhibition layers) such that the total coated amounts became $4\times10^{-5}$ mole/m$^2$. In addition, it was confirmed by the cross-sectional photograph that the addition compound did not remain in the added layer but was almost uniformly diffused in the whole layers during coating.

TABLE 6

| | Used Compound ($4 \times 10^{-5}$ mole/m$^2$) (The compound was added to the 2nd and 4th layers, individually. The comound diffuses into the whole coating layer.) | | | | | | | |
|---|---|---|---|---|---|---|---|---|
| Spt | — | Comp. A | Comp. C | (3) | (38) | (42) | (57) | (81) |
| K | 200 | 208 | 216 | 224 | 232 | 240 | 248 | 256 |
| L | 201 | 209 | 217 | 225* | 233* | 241* | 249* | 257* |
| M | 202 | 210 | 218 | 226* | 234* | 242* | 250* | 258* |
| N | 203 | 211 | 219 | 227* | 235* | 243* | 251* | 259* |
| O | 204 | 212 | 220 | 228* | 236* | 244* | 252* | 260* |
| P | 205 | 213 | 221 | 229* | 237* | 245* | 253* | 261* |
| Q | 206 | 214 | 222 | 230 | 238 | 246 | 254 | 262 |
| R | 207 | 215 | 223 | 231* | 239* | 247* | 255* | 263* |

In the above table, compound C was a comparison compound, the compounds (3), (38), (42), (57), and (81) were compounds of this invention, and in the samples 200 to 263, the mark * means the sample of this invention.

On the samples obtained, the same evaluations as in Example 2 were performed. Also, for the purpose of evaluating the effect of the support for the sharpness of the sample, the CTF evaluation as in Example 2 was carried out on the samples 201 to 207.

The results obtained are shown in Table 7 below.

TABLE 7

| | Addition Compound | | | | | | | |
|---|---|---|---|---|---|---|---|---|
| Sup. | — | Compound A | Compound C | (3) | (38) | (42) | (57) | (81) |
| K | Sample 200 ○ 5.8 | Sample 208 ○ | Sample 216 ○ | Sample 224 ○ | Sample 232 ○ | Sample 240 ○ | Sample 248 ○ | Sample 256 ○ |
| L | Sample 201 Δ 7.1 | Sample 209 Δ | Sample 217 Δ | 225 ○ | Sample 233 ○ | Sample 241 ○ | Sample 249 ○ | Sample 257 ○ |
| M | Sample 202 X 10.9 | Sample 210 X | 218 X X | Sample 226 ○ | Sample 234 ○ | Sample 242 ○ | Sample 250 ○ | Sample 258 ○ |
| N | Sample 203 X–XX 18.3 | Sample 211 X | Sample 219 X–XX | Sample 227 ○ | Sample 235 ○ | Sample 243 ○ | Sample 251 ○ | Sample 259 ○ |
| O | Sample 204 XX 20.2 | Sample 212 X | Sample 220 XX | Sample 228 ○–Δ | Sample 236 ○–Δ | Sample 244 ○–Δ | Sample 252 ○–Δ | Sample 260 ○–Δ |
| P | Sample 205 XX 24.6 | Sample 213 XX | Sample 221 XX | Sample 229 Δ | Sample 237 Δ | Sample 245 Δ | Sample 253 Δ | Sample 261 Δ |
| Q | Sample 206 ○ 5.6 | Sample 214 ○ | Sample 222 ○ | Sample 230 ○ | Sample 238 ○ | Sample 246 ○ | Sample 254 ○ | Sample 262 ○ |
| R | Sample 207 X–XX 18.1 | Sample 215 X | Sample 223 X–XX | Sample 231 ○ | Sample 239 ○ | Sample 247 ○ | Sample 255 ○ | Sample 263 ○ |

The characters of the evaluations were same as the scratch test method described before. In the above Table, the left side shows the scratch evaluation of samples 200 to 263 and the right side shows the sharpness evaluation c(lines/mm) of samples 200 to 207.

In the samples 216 to 223 using the comparison compound C, coloring with the compound C after processing was very severe.

From the results obtained, it can be seen that by using the support having the waterproof resin coated layer having the titanium oxide content of at least 2.0 g/m$^2$, the sharpness is excellent but the scratch for is increased. It can be also seen that the extent of the formation of the scratch fog is increased with the increase of the amount of titanium oxide used. On the other hand, it can be seen that by using the compound of this invention, the light-sensitive material giving less scratch fog and being excellent in sharpness can be obtained.

EXAMPLE 4

By following the same procedures as the case of preparing the samples 100 to 169 in Example 2 and the samples 200 to 263 in Example 3 except that the compositions of Layers 2, 3, and 4 were changed as shown below and the dye shown below was used as the irradiation inhibiting dye (since the compound of this invention has the absorption in the same visible region as the dye, the actual irradiation inhibition effect of the light-sensitive material was the sum of the effect of the irradiation inhibition dye and the effect of the compound of this invention), samples 100' to 169' and samples 200' to 263' were prepared.

| | |
|---|---|
| Layer 2 (Color mixing inhibition layer) | |
| Gelatin | 0.99 |
| Color mixing inhibitor (Cpd-A) | 0.04 |
| Color mixing inhibitor (Cpd-B) | 0.04 |
| Solvent (Solv-2) | 0.16 |
| Solvent (Solv-3) | 0.08 |
| Layer 3 (Green-sensitive emulsion layer) | |
| Silver chlorobromide emulsion B-1 | 0.13 |
| Gelatin | 1.24 |
| Magenta coupler (M-A) | 0.26 |
| Color image stabilizer (Cpd-8) | 0.03 |
| Color image stabilizer (Cpd-5) | 0.04 |
| Color image stabilizer (Cpd-6) | 0.02 |
| Color image stabilizer (Cpd-2) | 0.02 |
| Solvent (Solv-8) | 0.30 |

-continued

| | |
|---|---|
| Solvent (Solv-9) | 0.15 |
| Layer 4 (Color mixing inhibition layer) | |
| Gelatin | 0.70 |
| Color mixing inhibitor (Cpd-A) | 0.03 |
| Color mixing inhibitor (Cpd-B) | 0.03 |
| Solvent (Solv-2) | 0.11 |
| Solvent (Solv-3) | 0.06 |
| Solvent (Solv-10) | 0.02 |

The compounds newly used in the above sample are shown below.

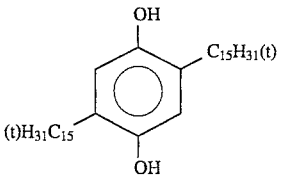
(Cpd-A)
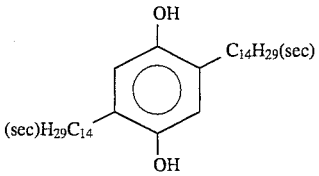
(Cpd-B)
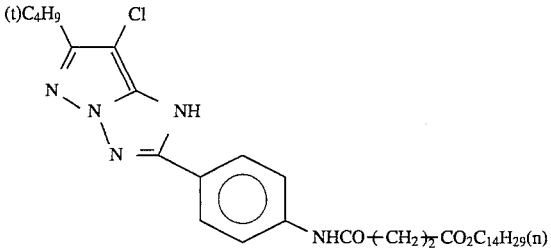
(M-A)
$O{=}P(OC_{16}H_{13}(n))_3$
(Solv-8)
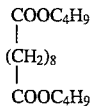
(Solv-9)
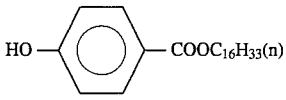
(Solv-10)
Anti-irradiation dye
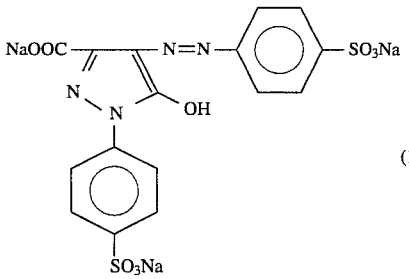
(10 mg/m²)
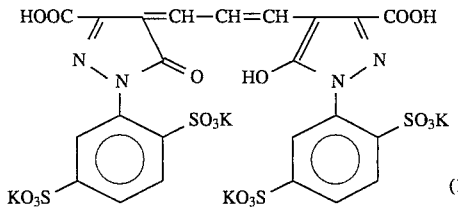
(1 mg/m²)
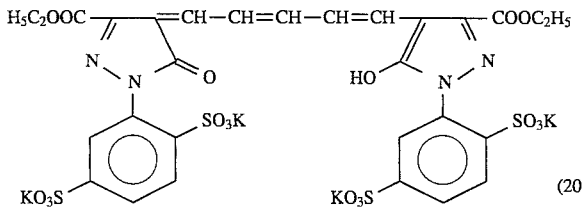
(20 mg/m²)
and -continued

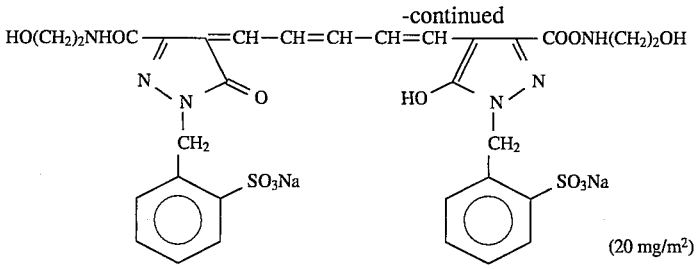

(20 mg/m²)

On the samples obtained, the same evaluations as in Example 2 were performed. The results obtained were almost same as those in Example 2 and the effect was remarkable in the construction of the present invention.

EXAMPLE 5

A color negative film (a) wherein the support was a triacetyl cellulose and a color negative film (b) wherein the support was composed of polyethylene terephthalate and polyethylene naphthalate were used. The frames of the same scene photographed to these color negative films each was printed to the samples prepared in Examples 2 and 3 using an automatic printer and the psychological evaluation of the sharpness of this invention was performed. The results obtained showed that the light-sensitive material having the larger value of the evaluation C (lines/mm) for sharpness showed a more excellent sharpness. Furthermore, when the color negative film (b) wherein the support was composed of polyethylene terephthalate and polyethylene naphthalate was used, the sharpness of the light-sensitive material was very excellent.

EXAMPLE 6

On the samples prepared in Examples 2 and 3, the same evaluations as in Example 2 were carried out except that the following light exposure was performed and the results obtained were almost same as these in Examples 2 and 3.

(Light Exposure)

As the light source, light of 473 nm obtained by converting the wavelength of the YAG solid state laser (oscillation wavelength, 946 nm) using a semiconductor laser GaAlAs (oscillation wavelength 808.5 nm) as an excitation light source by the SHG crystal of $KNbO_3$, light of 532 nm obtained by converting the wavelength of a $YVO_4$ solid state laser (oscillation wavelength, 1064 nm) using a semiconductor laser GaAlAs (oscillation wavelength, 808.7 nm) as an excitation light source by the SHG crystal of KTP, and AlGaInP (oscillation wavelength, about 670 nm, Type TPLD9211, made by TOSHIBA CORPORATION) were used. In the scanning apparatus being used, the laser light could successively scan the color photographic printing paper moving to the vertical direction to the scanning direction by a rotary polyhydron. By using the scanning apparatus, the relation D-logE of the density (D) of the light-sensitive material and the light intensity (E) was obtained by changing the light intensity. In this case, the light intensity of each of the three lights of three wavelengths was modulated using an external modulator of control the exposure intensity. The scanning exposure was carried out at 400 dpi and in this case, the average exposure time per pixel was about $5\times10^{-8}$ second. The temperature of the semiconductor laser was kept at a constant value using a Peltier element for restraining the fluctuation of the light intensity.

By incorporating the compound of this invention in the layers constituting the photographic light-sensitive material, the formation of the pressure fog can be effectively restrained even by using a reflective support giving a high sharpness.

While the invention has been described in detail and with reference to specific embodiments thereof, it will be apparent to one skilled in the art that various changes and modifications can be made therein without departing from the spirits and scope thereof.

What is claimed is:

1. A silver halide photographic material comprising a reflective support having thereon at least one light-sensitive layer containing silver halide emulsion grains and at least one waterproof resin coated layer which is on the same side of the reflective support as the at least one light-sensitive layer, wherein the waterproof resin coated layer contains at least 2 g/m² of a white pigment, and wherein the at least one light-sensitive layer contains at least one compound represented by the following general formula (I) in a molecular dispersion state of a monomolecule or a dimer;

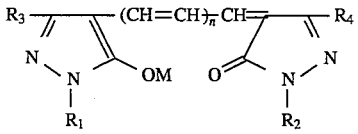

(I)

wherein $R_1$, $R_2$, $R_3$ and $R_4$ each represents a hydrogen atom or a substituent selected from the group consisting of an alkyl group, —$COOR_5$, —$CONR_6R_7$, —$CONHR_8$, —$NR_9COR_{10}$, —$NR_{11}R_{12}$, —CN, —$OR_{13}$, and —$NR_{14}CONR_{15}R_{16}$, wherein $R_5$, $R_6$, $R_7$, $R_8$, $R_9$, $R_{10}$, $R_{11}$, $R_{12}$, $R_{13}$, $R_{14}$, and $R_{16}$ each represents a hydrogen atom or an alkyl group, and wherein the sum total of the atomic weights of at least one of ($R_1$+$R_3$) or ($R_2$+$R_4$) is not more than 160; n represents 0, 1, or 2; and M represents an alkali metal.

2. A silver halide photographic material described in claim 1, wherein $R_1$, $R_2$, $R_3$, and $R_4$ of general formula (I) do not represent a sulfonic acid group, a carboxy group, or a phosphoric acid group, and wherein $R_1$, $R_2$, $R_3$ and $R_4$ are not substituted with a sulfonic acid group, a carboxy group or a phosphoric acid group.

3. A silver halide photographic material described in claim 2, wherein $R_1$, $R_2$, $R_3$, and $R_4$ of the general formula (I) each is a hydrogen atom or a substituent selected from the group consisting of an alkyl group, —$COOR_5$, —$CONR_6R_7$, —$CONHR_8$, —$NR_9COR_{10}$, —$NR_{11}R_{12}$, —CN, —$OR_{13}$, and —$NR_{14}CONR_{15}R_{16}$, wherein $R_5$, $R_6$, $R_7$, $R_8$, $R_9$, $R_{10}$, $R_{11}$, $R_{12}$, $R_{13}$, $R_{14}$, $R_{15}$ and $R_{16}$ each represents a hydrogen atom or an alkyl group and said $R_6$ and $R_7$, said $R_{11}$ and $R_{12}$, or said $R_{15}$ and $R_{16}$ may form a ring.

4. A silver halide photographic material described in claim 3, wherein $R_6$, $R_7$, $R_8$, $R_9$, $R_{10}$, $R_{11}$, $R_{12}$, $R_{13}$, $R_{14}$, $R_{15}$ and $R_{16}$ each represents a hydrogen atom, an unsubstituted alkyl group, or an alkyl group substituted with a hydroxy group or an ether group, that does not contain a sulfonic acid group, a carboxy group, or a phosphoric acid group.

5. A silver halide photographic material described in claim 1, wherein the compound shown by the general formula (I) is a compound represented by general formula (II);

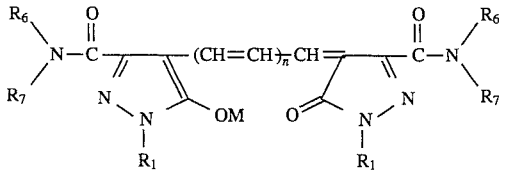

(II)

wherein $R_1$, $R_6$, and $R_7$ each represents a hydrogen atom or an alkyl group, wherein the sum total of the atomic weights of $R_1$, $R_6$, and $R_7$ is not more than 120; n represents 0, 1, or 2; M represents an alkali metal, and $R_6$ and $R_7$ may combine with each other to form a hetero-ring.

6. A silver halide photographic material described in claim 5, wherein $R_1$, $R_6$, and $R_7$ each represent a hydrogen atom, an unsubstituted alkyl group, or an alkyl group substituted with a hydroxy group or an ether group.

7. A silver halide photographic material described in claim 6, wherein the substituents represented by $R_1$, $R_6$, and $R_7$ of the general formula (II) do not have a sulfonic acid group, a carboxy group or a phosphoric acid group.

8. A silver halide photographic material described in claim 1, wherein said reflective support is composed of a base material, and at least two or more waterproof resin coated layers are present on the light-sensitive silver halide emulsion layer coated side, and wherein said waterproof resin coated layers each has a different content in weight %, of a white pigment.

9. A silver halide photographic material described in claim 8, wherein the at least two or more waterproof resin coated layers each has a different content of white pigment, and wherein the content in weight %, of the white pigment in a waterproof resin coated layer nearest the base material is lower than the content of the white pigment in the at least one other waterproof resin coated layer.

10. A silver halide photographic material described in claim 8, wherein the at least two waterproof resin coated layers each has a different content of white pigment, and wherein the content in weight %, of the white pigment is the highest in the waterproof resin coated layer nearest the light-sensitive layer.

11. A silver halide photographic material described in claim 8, wherein said reflective support has at least three waterproof resin coated layers each has a different content of white pigment, and wherein the content in weight %, of the white pigment is the highest in an intermediate layer(s) between the waterproof resin coated layer nearest the light-sensitive silver halide emulsion layer and the waterproof resin coated layer nearest the base material.

12. A silver halide photographic material described in claim 8, wherein the white pigment in the waterproof resin coated layers of the reflective support is titanium oxide and a weight ratio of the white pigment to the resin in the waterproof resin coated layer having the highest content (weight %) of the white pigment is 10/90 to 50/50 (titanium oxide/the resin).

13. A silver halide photographic material described in claim 1, wherein the at least one waterproof resin coated layer on the same side of the reflective support as the light-sensitive layer of said reflective support has a composition prepared by mixing and dispersing titanium oxide in a resin composition comprised of a polyester synthesized by the condensation polymerization of a dicarboxylic acid and a diol, and the weight ratio of titanium oxide to the resin is 10/90 to 40/60 (titanium oxide/resin).

14. A silver halide photographic material described in claim 13, wherein the polyester of said reflective support is a polyester comprised of polyethylene terephthalate.

15. A silver halide color photographic material described in claim 1, comprising three light-sensitive layers containing silver halide grains, wherein each light-sensitive layer provides a different color sensitivity, wherein a first light-sensitive layer is a hydrophilic colloid layer containing at least one yellow producing coupler, a second light-sensitive layer is a hydrophilic colloid layer containing at least one magenta producing coupler, and a third light-sensitive layer is a hydrophilic colloid layer containing at least one cyan producing coupler, and wherein each light-sensitive layer has a silver chloride content of at least 95 mol %.

16. A silver halide photographic material described in claim 1, wherein $R_6$, $R_7$, $R_8$, $R_9$, $R_{10}$, $R_{11}$, $R_{12}$, $R_{13}$, $R_{14}$, $R_{15}$ and $R_{16}$ each represents a hydrogen atom, an unsubstituted alkyl group, or an alkyl group substituted with a hydroxy group or an ether group.

17. A silver halide photographic material comprising a support having thereon at least one light-sensitive silver halide emulsion layer and at least one light-insensitive hydrophilic colloid layer, wherein at least one layer of said light-sensitive silver halide emulsion layer and at least one layer of said light-insensitive hydrophilic colloid layer each contains a compound represented by the following general formula (II), in a molecular dispersion state of a monomolecule or a dimer;

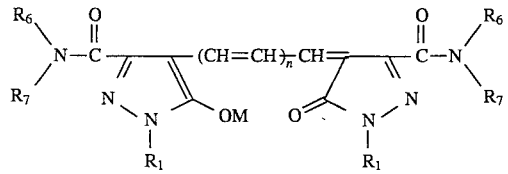

(II)

wherein $R_1$, $R_6$ and $R_7$ each represents a hydrogen atom or an alkyl group, and wherein the sum total of the atomic weights of $R_1$, $R_6$ and $R_7$ is not more than 120; n represents 0, 1 or 2; M represents an alkali metal, and $R_6$ and $R_7$ may combine with each other to form a hetero-ring.

18. A silver halide photographic material described in claim 17, wherein $R_1$, $R_6$ and $R_7$ each represent a hydrogen atom, an unsubstituted alkyl group, or an alkyl group substituted with a hydroxy group or an ether group.

19. A color image forming process comprising printing, through a color negative film having a support composed of polyethylene terephthalate or polyethylene naphthalate, a silver halide color photographic material comprising a reflective support having thereon at least one light-sensitive layer containing silver halide emulsion grains and, at least one waterproof resin coated layer which is on the same side of the reflective support as the at least one light-sensitive layer, wherein the waterproof resin coated layer contains at least 2 g/m$^2$ of a white pigment, and wherein at least one light-sensitive layer contains at least one compound represented by the following general formula (I) in a molecular dispersion state of a monomolecule or a dimer;

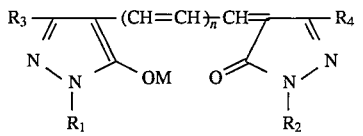

(I)

wherein $R_1$, $R_2$, $R_3$, and $R_4$ each represents a hydrogen atom an alkyl group, —$COOR_5$, —$CONR_6R_7$, —$CONHR_8$, —$NR_9COR_{10}$, —$NR_{11}R_{12}$, —CN, —$OR_{13}$, or —$NR_{14}CONR_{15}R_{16}$, wherein $R_5$, $R_6$, $R_7$, $R_8$, $R_9$, $R_{10}$, $R_{11}$, $R_{12}$, $R_{13}$, $R_{14}$, $R_{15}$ and $R_{16}$ each represents a hydrogen atom or an alkyl group, the sum total of the atomic weights of at least one of ($R_1$+$R_3$) or ($R_2$+$R_4$) is not more than 160; n represents 0, 1, or 2; and M represents an alkali metal.

20. A color image forming process described in claim 19, comprising three light-sensitive layers containing silver halide grains, wherein each light-sensitive layer provides a different color sensitivity, wherein a first light-sensitive layer is a hydrophilic colloid layer containing at least one yellow producing coupler, a second light-sensitive layer is a hydrophilic colloid layer containing at least one magenta producing coupler, and a third light-sensitive layer is a hydrophilic colloid layer containing at least one cyan producing coupler, and wherein each light-sensitive layer has a silver chloride content of at least 95 mole %.

* * * * *